US012404679B2

(12) United States Patent
Kragness et al.

(10) Patent No.: US 12,404,679 B2
(45) Date of Patent: Sep. 2, 2025

(54) BUILDING COVERING SYSTEM INCORPORATING A BUILDING PANEL, AND METHODS OF FORMING AND INSTALLING THE SAME

(71) Applicant: ARMSTRONG WORLD INDUSTRIES, INC., Lancaster, PA (US)

(72) Inventors: Eric D. Kragness, Sinking Spring, PA (US); Jason T. Cavanaugh, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 95 days.

(21) Appl. No.: 17/894,562

(22) Filed: Aug. 24, 2022

(65) Prior Publication Data

US 2023/0060772 A1 Mar. 2, 2023

Related U.S. Application Data

(60) Provisional application No. 63/237,325, filed on Aug. 26, 2021.

(51) Int. Cl.
*E04B 2/00* (2006.01)
*E04F 13/08* (2006.01)

(52) U.S. Cl.
CPC ..... *E04F 13/0866* (2013.01)

(58) Field of Classification Search
CPC ..... E04F 13/0866; E04F 13/0803
See application file for complete search history.

(56) References Cited

U.S. PATENT DOCUMENTS

| | | | | |
|---|---|---|---|---|
| 2,126,956 | A | 8/1938 | Gilbert | |
| 3,084,402 | A | 4/1963 | Jordan | |
| 3,339,784 | A * | 9/1967 | Filstead, Jr. | F17C 3/025 220/560.11 |
| 3,879,240 | A * | 4/1975 | Wall | B60P 3/32 264/46.7 |
| 6,012,255 | A * | 1/2000 | Smid | E04C 2/043 52/745.19 |
| 8,925,677 | B2 | 1/2015 | Dugan | |
| 10,221,562 | B2 | 3/2019 | Fay | |
| 2003/0000901 | A1* | 1/2003 | Salatin | A47F 5/0846 211/85.16 |
| 2005/0055935 | A1* | 3/2005 | Layfield | E04B 2/7411 52/506.01 |
| 2006/0000670 | A1 | 1/2006 | Dodd | |

(Continued)

FOREIGN PATENT DOCUMENTS

| | | | |
|---|---|---|---|
| EP | 2840195 | A1 | 2/2015 |
| KR | 2018/0025688 | | 3/2018 |
| KR | 10-2020-0046936 | A | 5/2020 |

*Primary Examiner* — Basil S Katcheves
(74) *Attorney, Agent, or Firm* — Patrick Sheldrake

(57) ABSTRACT

Described herein is a building system comprising: a plurality of support members each comprising a support surface, a plurality of first building panels secured to the support surface of the plurality of support members, each of the plurality of first building panels comprising a non-porous body, a plurality of second building panels secured to the plurality of first building panels by an adhesive and a first plurality of mechanical fasteners, each of the plurality of the second building panels comprising a porous body.

10 Claims, 18 Drawing Sheets

(56) References Cited

U.S. PATENT DOCUMENTS

| | | | | |
|---|---|---|---|---|
| 2006/0019568 | A1 | 1/2006 | Toas | |
| 2006/0191743 | A1 | 8/2006 | Pike | |
| 2012/0291384 | A1 | 11/2012 | Martens | |
| 2014/0162224 | A1* | 6/2014 | Wallace | G09B 5/06 434/219 |
| 2015/0275518 | A1* | 10/2015 | Flick | E04C 2/26 428/189 |
| 2017/0037639 | A1 | 2/2017 | Taylor | |
| 2020/0002938 | A1 | 1/2020 | Buck | |
| 2020/0173172 | A1 | 6/2020 | Kragness | |

* cited by examiner

BUILDING COVERING SYSTEM INCORPORATING A BUILDING PANEL, AND METHODS OF FORMING AND INSTALLING THE SAME

CROSS-REFERENCE TO RELATED APPLICATIONS

The present application claims the benefit of priority to U.S. Provisional Patent Application Ser. No. 63/237,325, filed Aug. 26, 2021, the entirety of which is incorporated herein by reference.

BACKGROUND

Creating an aesthetically pleasing and structurally stable building system may require both skilled labor as well as specialty building hardware that may drive up the cost of installation. Therefore, a need exists for a building system that may exhibit the desired aesthetic characteristics that may be installed without necessitating specialty hardware and/or specialized labor to create the finished system.

BRIEF SUMMARY

The present invention is directed to a building system comprising: a plurality of support members each comprising a support surface; a plurality of first building panels secured to the support surface of the plurality of support members, each of the plurality of first building panels comprising a non-porous body; a plurality of second building panels secured to the plurality of first building panels by an adhesive and a plurality of first mechanical fasteners, each of the plurality of the second building panels comprising a porous body.

Other embodiments of the present invention include a building system comprising: a plurality of support members; a plurality of first building panels each having a first major surface opposite a second major surface and a side surface extending there-between; a plurality of second building panels each having a first major surface opposite a second major surface and a side surface extending there-between; wherein the plurality of first building panels are secured to the plurality of support members; wherein the plurality of second building panels are secured to the plurality of first building panels by an adhesive; and wherein the plurality of second building panels and the plurality of first building panels arranged in an offset pattern such that the side surface of at least one of the plurality of first building panels and the side surface of at least one of the plurality of second building panels are not co-planar.

Other embodiments of the present invention include a method of installing a building system comprising: a) bringing into contact a second major surface of at least one facing building panel and a pre-existing building surface of a pre-existing building layer to form a building interface, whereby adhesive is present in the interface; and b) driving at least one mechanical fastener into the at least one facing building panel such that the at least one mechanical fastener is located at least in a portion of the at least one facing building panel and the pre-existing building surface; wherein the at least one building panel comprises a porous body.

Other embodiments of the present invention include a method of installing a building system comprising: a) bringing into contact a plurality of facing building panels with a pre-existing building layer to form a building interface, whereby adhesive is present in the interface; and b) driving at least one mechanical fastener into the at least one facing building panel such that the at least one mechanical fastener is located at least in a portion of the at least one building panel and the pre-existing building surface; wherein the pre-existing building layer is formed of a plurality of backing building panels located immediately adjacent to each other; and wherein the plurality of facing building panels are arranged in an offset pattern relative to the plurality of backing building panels such that at least one edge of the facing building panels and at least one edge of the backing building panels are not co-planar.

Other embodiments of the present invention include a building system comprising: a plurality of support members comprising a support surface; a plurality of building panels each having a first major surface opposite a second major surface and a side surface extending there-between; wherein the plurality of building panels are secured to the plurality of support members by an adhesive and a plurality of fasteners; and wherein each of the plurality of building panels comprises a porous body, the porous body comprising a fibrous material.

Other embodiments of the present invention include a building system comprising: a plurality of support members comprising a support surface; a plurality of building panels each having a first major surface opposite a second major surface and a side surface extending there-between, each of the plurality of building panels having a panel thickness as measured from the first major surface to the second major surface of each of the plurality of building panels; wherein the plurality of building panels are secured to the plurality of support members by an adhesive and a plurality of fasteners; and wherein each of the plurality of fasteners has a fastener length as measured from a proximal end of the fastener to a distal end of the fastener and each of the plurality of fasteners has a head having an outer diameter; and wherein the distal end of each of the plurality of fasteners is located in the support member and the proximal end of each of the plurality of fasteners is located inset of the first major surface of the building panel by a depth that is a non-zero value.

Other embodiments of the present invention include a method of installing a building system comprising: a) bringing into contact a plurality of building panels with a pre-installed support grid comprising a support surface to form a first interface there-between, whereby adhesive is present in the first interface and each of the plurality of building panels has a panel thickness; and b) driving at least one mechanical fastener into the at least one building panel such that a distal end of the mechanical faster is inset of the first major surface by a depth that is a non-zero value, whereby the mechanical fastener extends through the first interface;

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
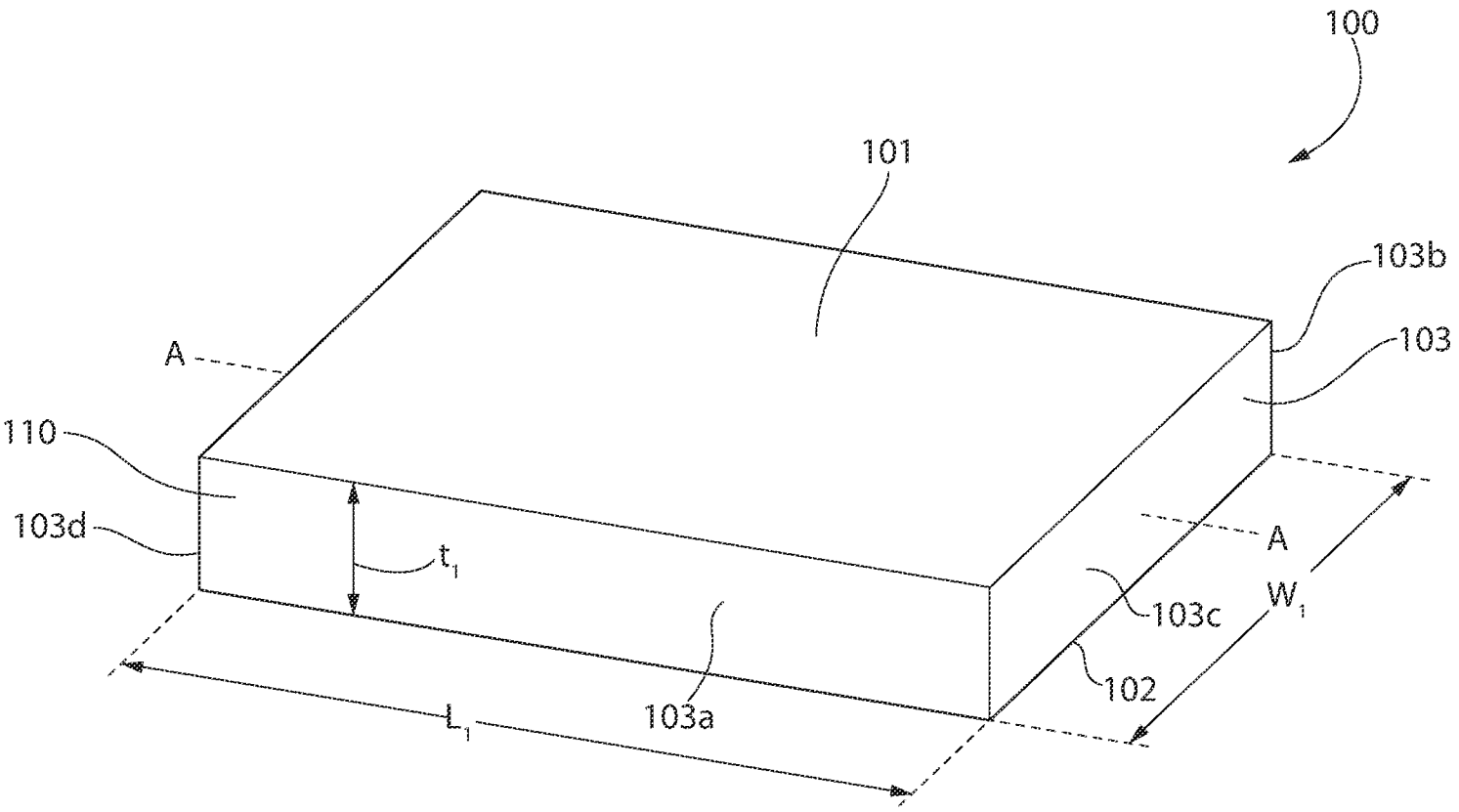
FIG. 1 is top perspective view of a first building panel according to the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means+/−5% of the reference value. According to the present application, the term "substantially free" less than about 0.1 wt. % based on the total of the referenced value.

Figure 3A:
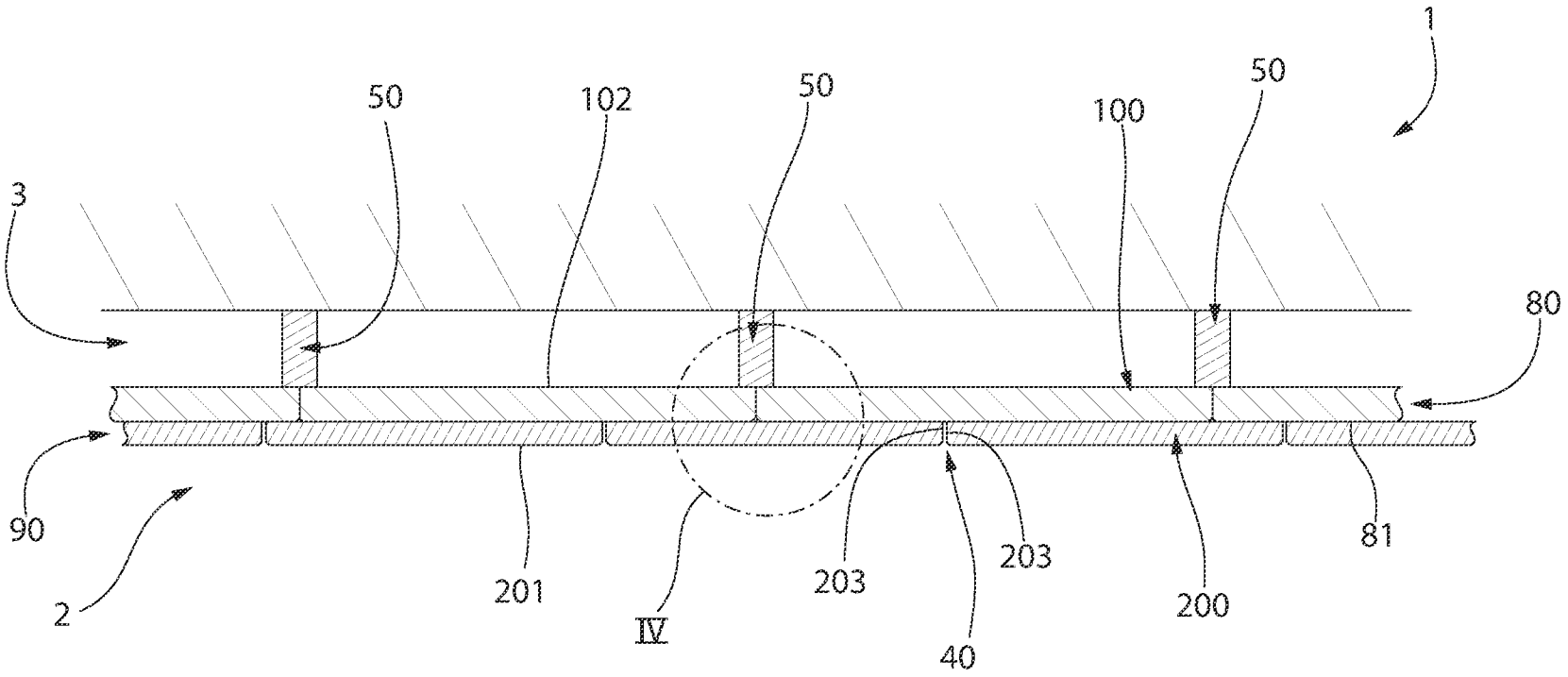
FIG. 3A is a building system according to one embodiment of the present invention that comprises the first and second building panels of the present invention.
Figure 4A:
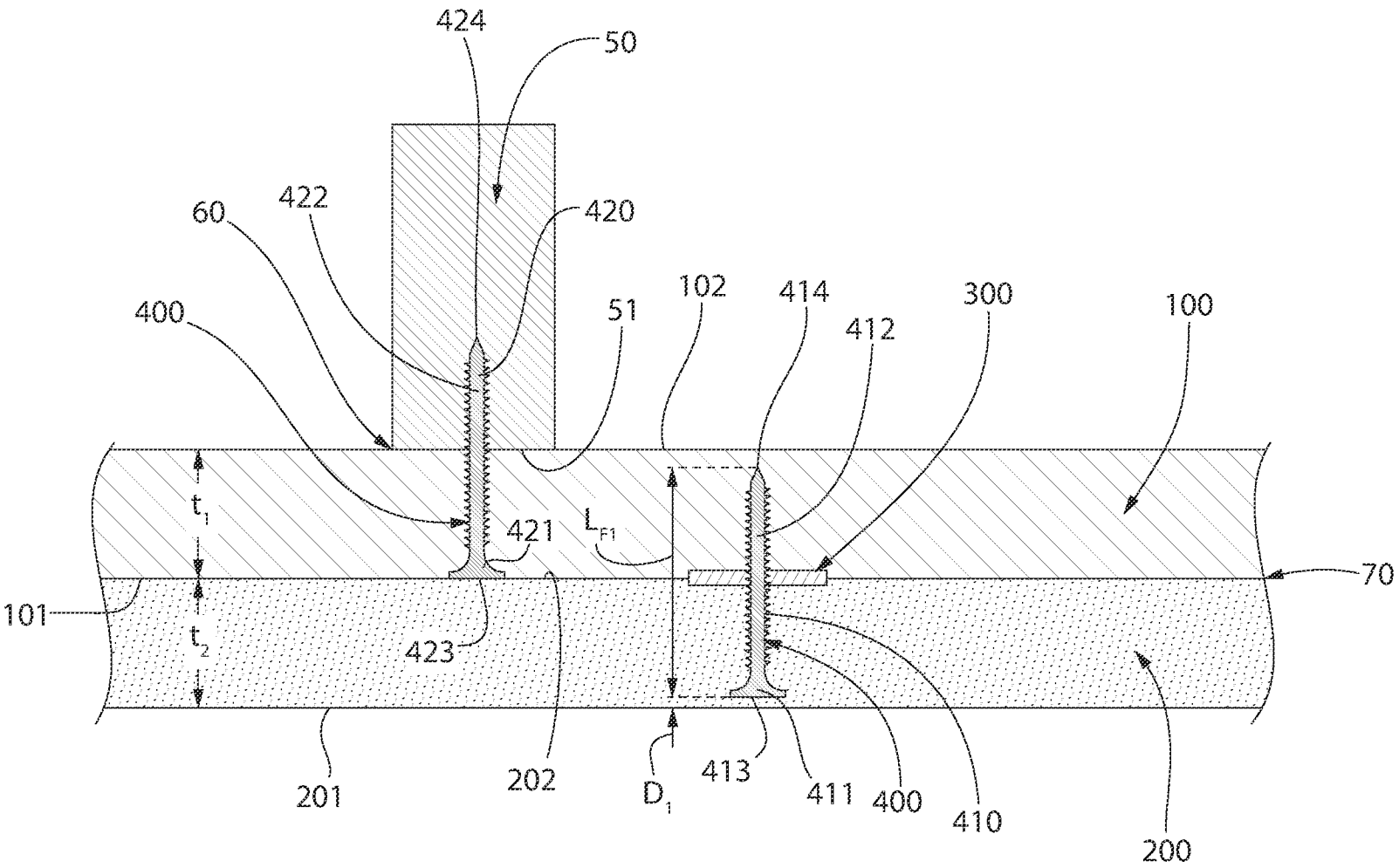
FIG. 4A is a close-up view of region IV shown in FIG. 3A.

Referring to FIGS. 3A and 4A, the building system 1 of the present invention may comprise a plurality of first building panels 100, a plurality of second building panels 200, and one or more support elements 50 (also referred to as a "support member"). The support element 50 may comprise a support surface 51.

Non-limiting examples of support structures include suspended ceiling grids, wall-studs (also called framing studs), and structural walls (e.g., ceiling formed by an adjacent subfloor in a multi-floor building, roof). In the non-limiting exemplified embodiment, the support structure 50 is a ceiling joist—whereby the ceiling joist forms the support surface 51. Although not shown, in other embodiments, the support element 50 may comprise an inverted T-bar having a horizontal flange and a vertical web—whereby the horizontal flange may form the support surface 51.

The building system 1 may be installed in an interior space, whereby the interior space comprises a plenary space 3 and an active room environment 2. The plenary space 3 provides space for mechanical lines within a building (e.g., HVAC, plumbing, etc.). The active space 2 provides room for the building occupants during normal intended use of the building (e.g., in an office building, the active space would be occupied by offices containing computers, lamps, etc.). The plenary space 3 may exist above the first building panels 100 and the active room environment 2 may exist below the second building panels 200.

Figure 3B:
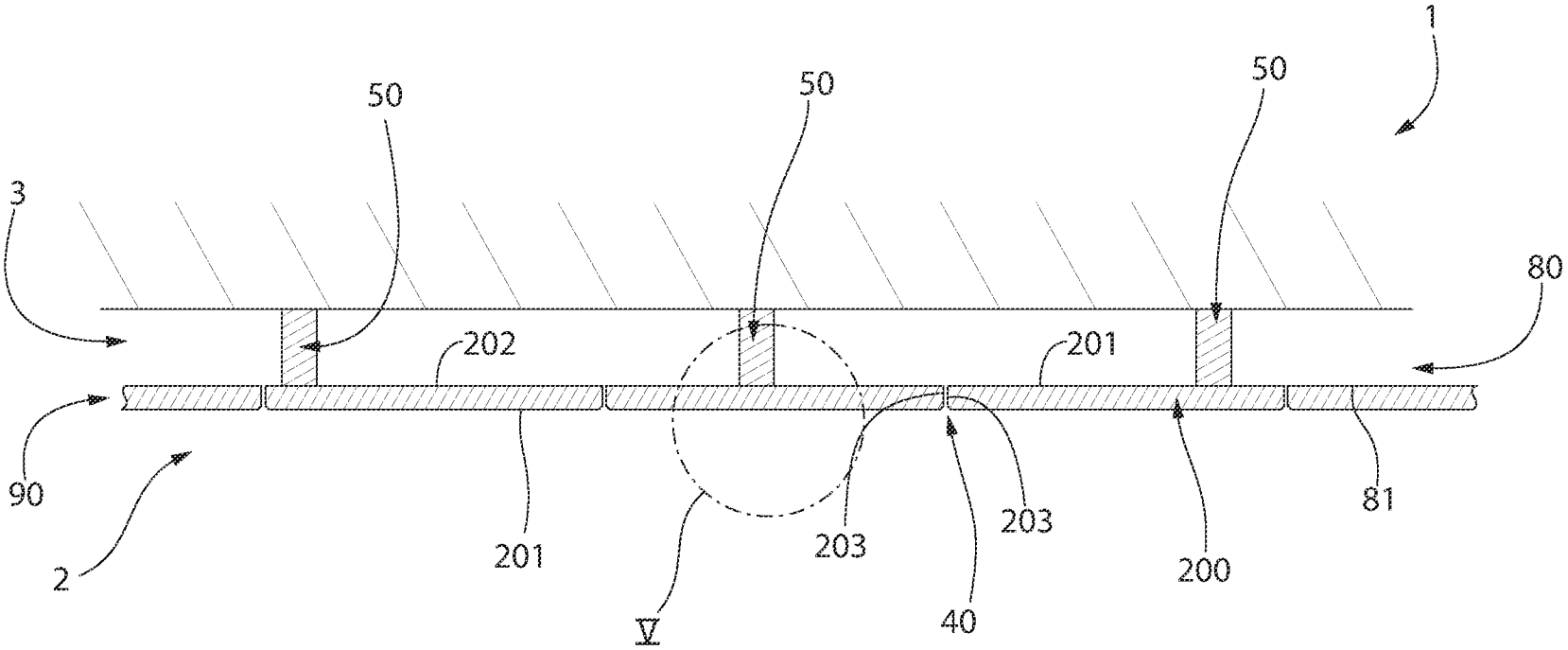
FIG. 3B is a building system according to another embodiment of the present invention that comprises the second building panels of the present invention.
Figure 4B:
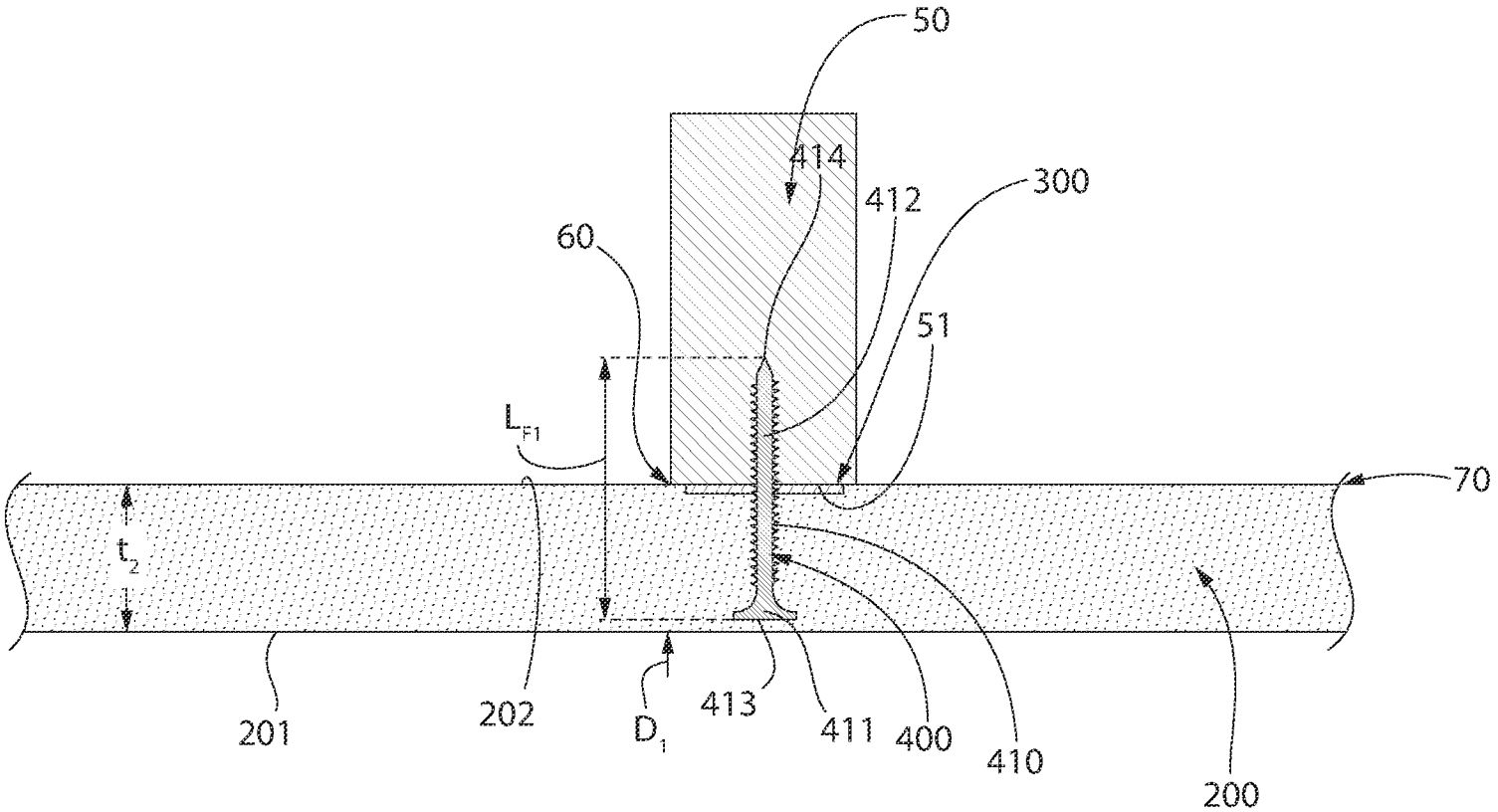
FIG. 4B is a close-up view of region V shown in FIG. 3B.
Figure 5A:
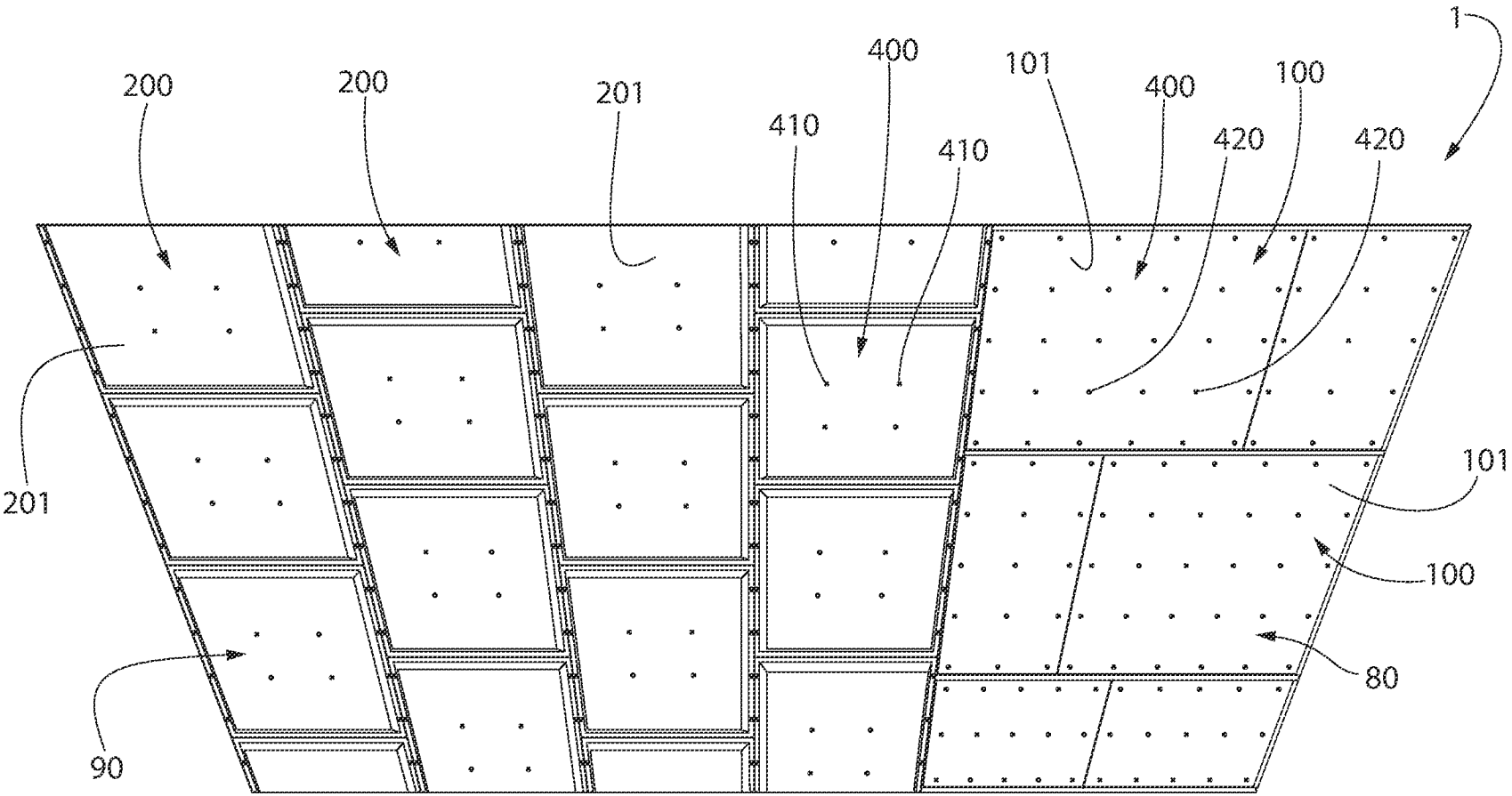
FIG. 5A is an upward facing perspective view of the building system of FIG. 3A during installation.
Figure 5B:
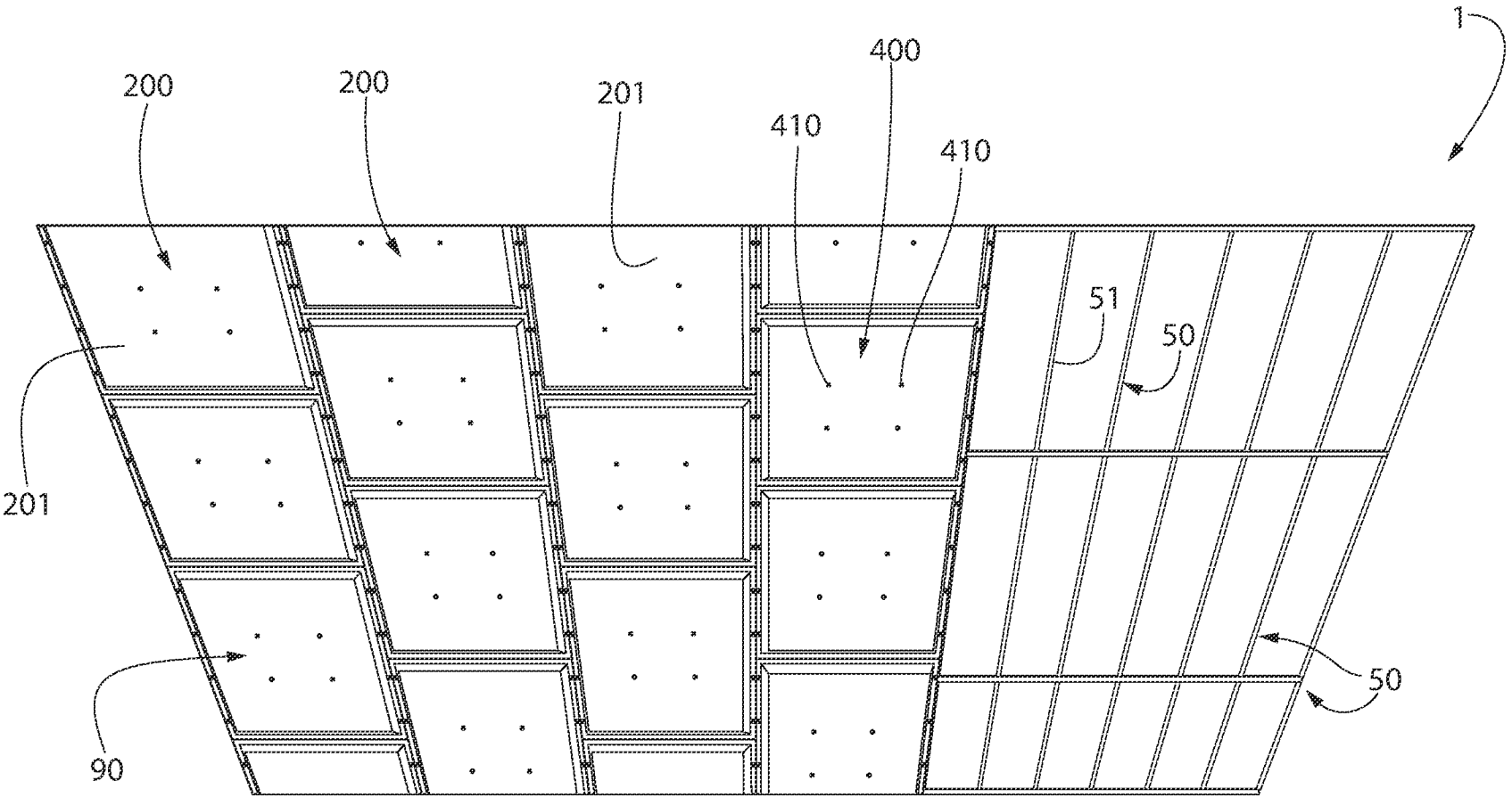
FIG. 5B is an upward facing perspective view of the building system of FIG. 3B during installation.
Figure 6:
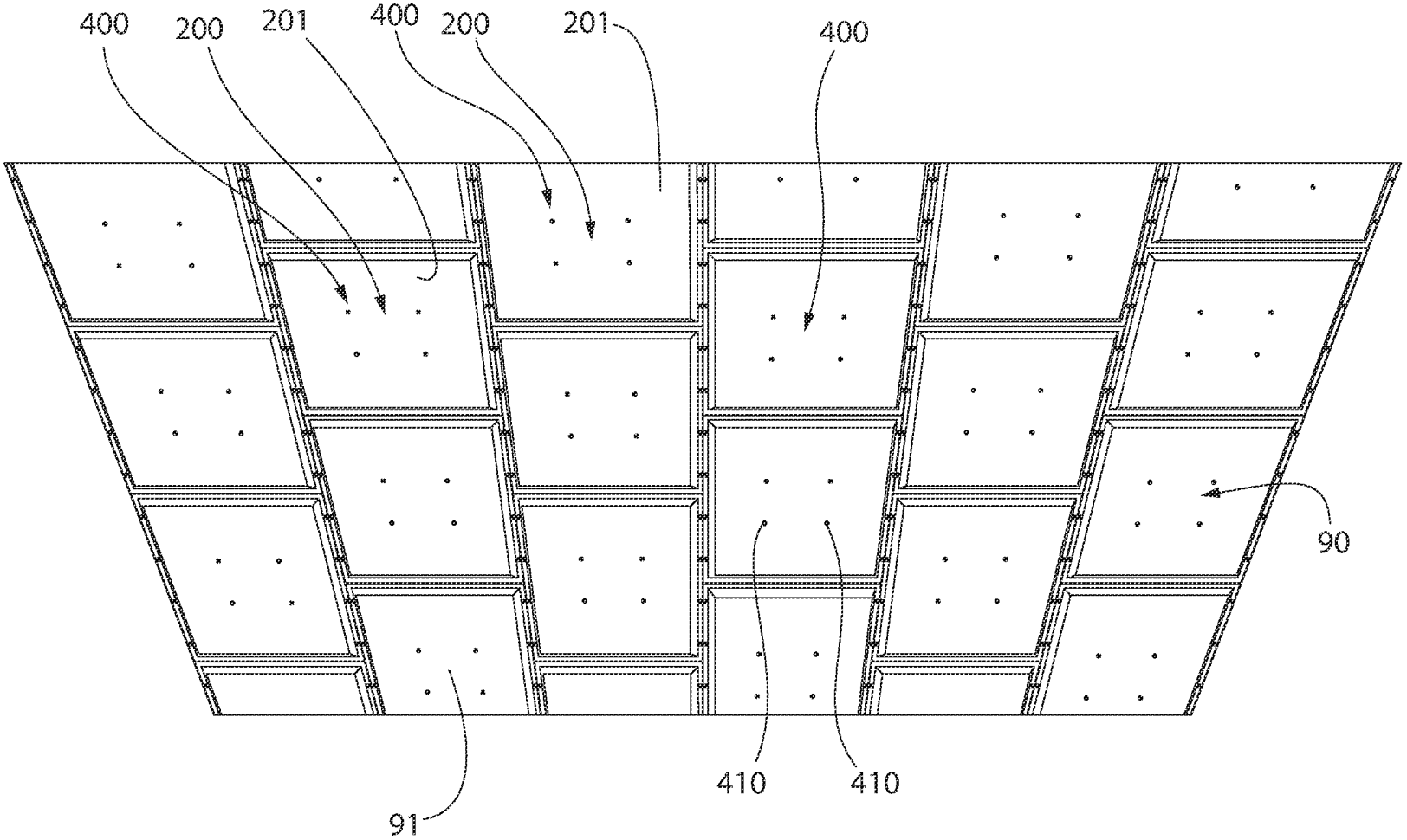
FIG. 6 is an upward facing perspective view of the building system during installation.

Referring to FIGS. 3B and 4B, other embodiments of the present invention include a building system 1 comprising a plurality of the second building panels 200 and one or more support elements 50 (also referred to as a "support member")—as discussed in greater detail herein.

Referring now to FIG. 1, the first building panel 100 (also referred to as a "backing building panel") may comprise a first major surface 101 opposite a second major surface 102 and a side surface 103 extending between the first and second major surfaces 101, 102.

The side surface 103 of the first building panel 100 may define a perimeter of the first building panel 100. The side surface 103 of the first building panel 100 may define a perimeter of the first major surface 101 of the first building panel 100. The side surface 103 of the first building panel 100 may define a perimeter of the second major surface 102 of the first building panel 100.

Depending on the shape of the first building panel 100, there may be a plurality of side surfaces 103. The first building panel 100 may be rectilinear in shape. The first building panel 100 may be elongated and extend along a first longitudinal axis A-A.

According to such embodiments, the side surface 103 of the first building panel 100 may comprise a first side surface 103*a*, a second side surface 1203*b*, a third side surface 103*c*, and a fourth side surface 103*d*. The first side surface 103*a* may be substantially parallel to the second side surface 103*b*. The third side surface 103*c* may be substantially parallel to the fourth side surface 103*c*. The first side surface 103*a* and the second side surface 103*b* may intersect the third side surface 103*c* and the fourth side surface 103*d*. The first side surface 103*a* and the second side surface 103*b* may each be substantially orthogonal to each of the third side surface 103*c* and the fourth side surface 103*d*.

The first longitudinal axis A-A may intersect the third side surface 103*c* and the fourth side surface 103*d*. The first longitudinal axis A-A may extend substantially parallel to the first side surface 103*a* and the second side surface 103*b*. The first longitudinal axis A-A may extend substantially orthogonal to the third side surface 103*c* and the fourth side surface 103*d*.

The first side surface 103*a* may be referred to as a first elongated side surface or a first elongated edge. The second side surface 103*b* may be referred to as a second elongated side surface or a second elongated edge. The third side surface 103*c* may be referred to as a first transverse side surface or a first transverse edge. The fourth side surface 103*d* may be referred to as a second transverse side surface or a second transverse edge.

The first building panel 100 may have a first thickness $t_1$ as measured from the first major surface 101 to the second major surface 102 of the first building panel 100. The first thickness $t_1$ may range from about 0.3 inches to about 0.75 inches—including all thicknesses and sub-ranges there-between. In some embodiments, the first thickness $t_1$ may range from about 0.375 inches to about 0.625 inch—including all lengths and sub-ranges there-between.

The first building panel 100 may have a first length $L_1$ as measured from the third side surface 103*c* to the fourth side surface 103*d*. The first length $L_1$ may range from about 84 inches to about 156 inches—including all lengths and sub-ranges there-between. In some embodiments, the first length $L_1$ may range from about 96 inches to about 144 inches—including all lengths and sub-ranges there-between. In some embodiments, the first length $L_1$ is about 96 inches. In some embodiments, the first length $L_1$ is about 120 inches.

The first building panel 100 may have a first width $W_1$ as measured from the first side surface 103*a* to the second side surface 103*b*. The first width $W_1$ may range from about 36 inches to about 60 inches—including all widths and sub-ranges there-between. In some embodiments, the first width $W_1$ may range from about 46 inches to about 50 inches—including all widths and sub-ranges there-between. In some embodiments, the first width $W_1$ is about 48 inches.

The first building panel 100 may comprise a first body 110. The first body 1110 may form the first major surface 101, the second major surface 102, and the side surface 103 of the first building panel 100.

The first body 110 may be a non-porous body. The term non-porous refers to the first body 110 preventing airflow through the first building panel 100 between the first major surface 101 and the second major surface 102 under atmospheric conditions.

The first building panel 100 may exhibit a CAC value of 30 or greater, preferably 35 or greater.

The first body 110 of the first building panel 100 may be formed of gypsum, plywood, particle board, drywall, or the combinations thereof.

The first building panel 100 may have a first density. The first density may range from about 16 lb./ft$^3$ to about 180 lb./ft$^3$—including all densities and sub-ranges there-between. In some embodiments, the first density may range from about 25 lb./ft$^3$ to about 100 lb./ft$^3$—including all densities and sub-ranges there-between.

Figure 2A:
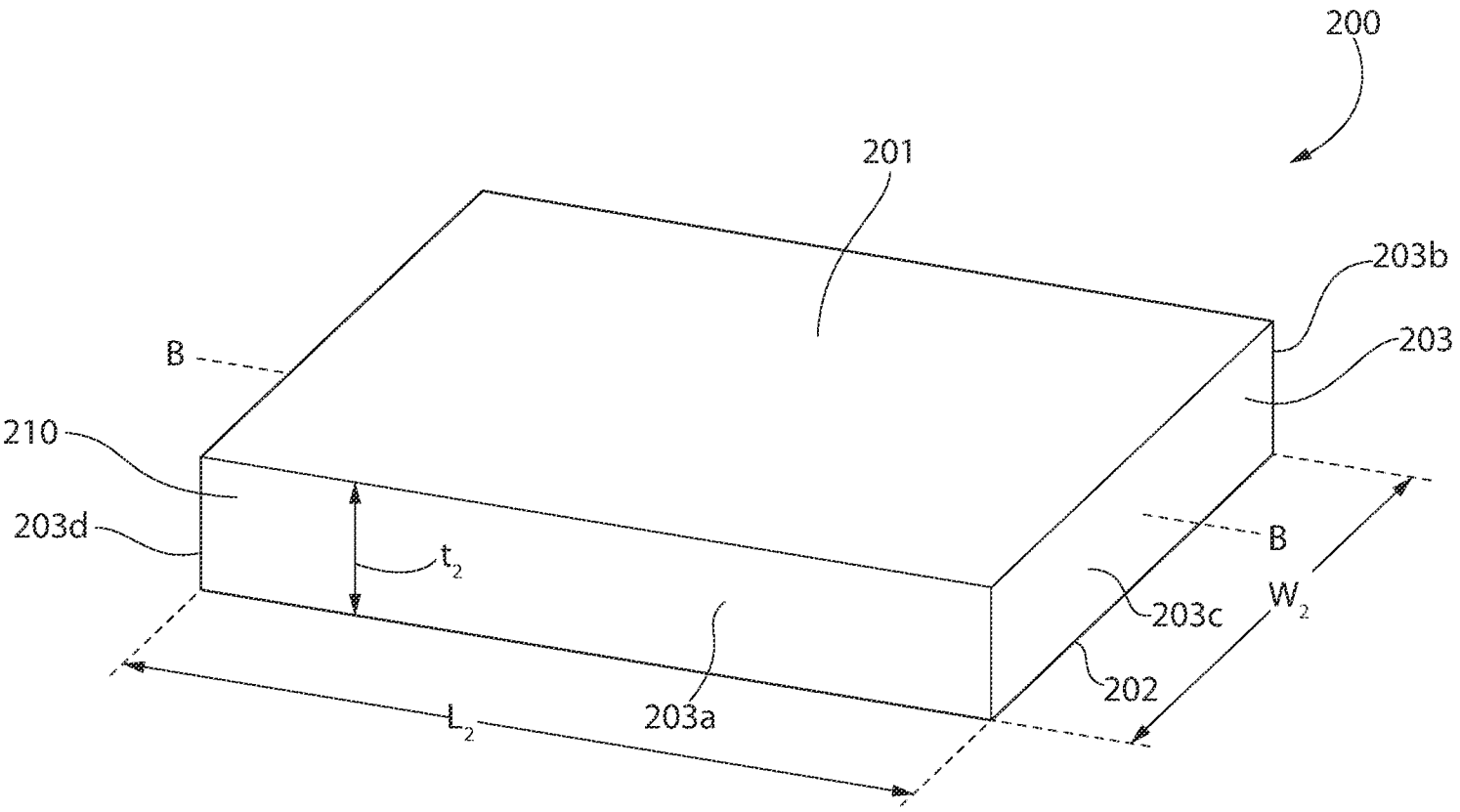
FIG. 2A is top perspective view of a second building panel according to the present invention.
Figure 2B:
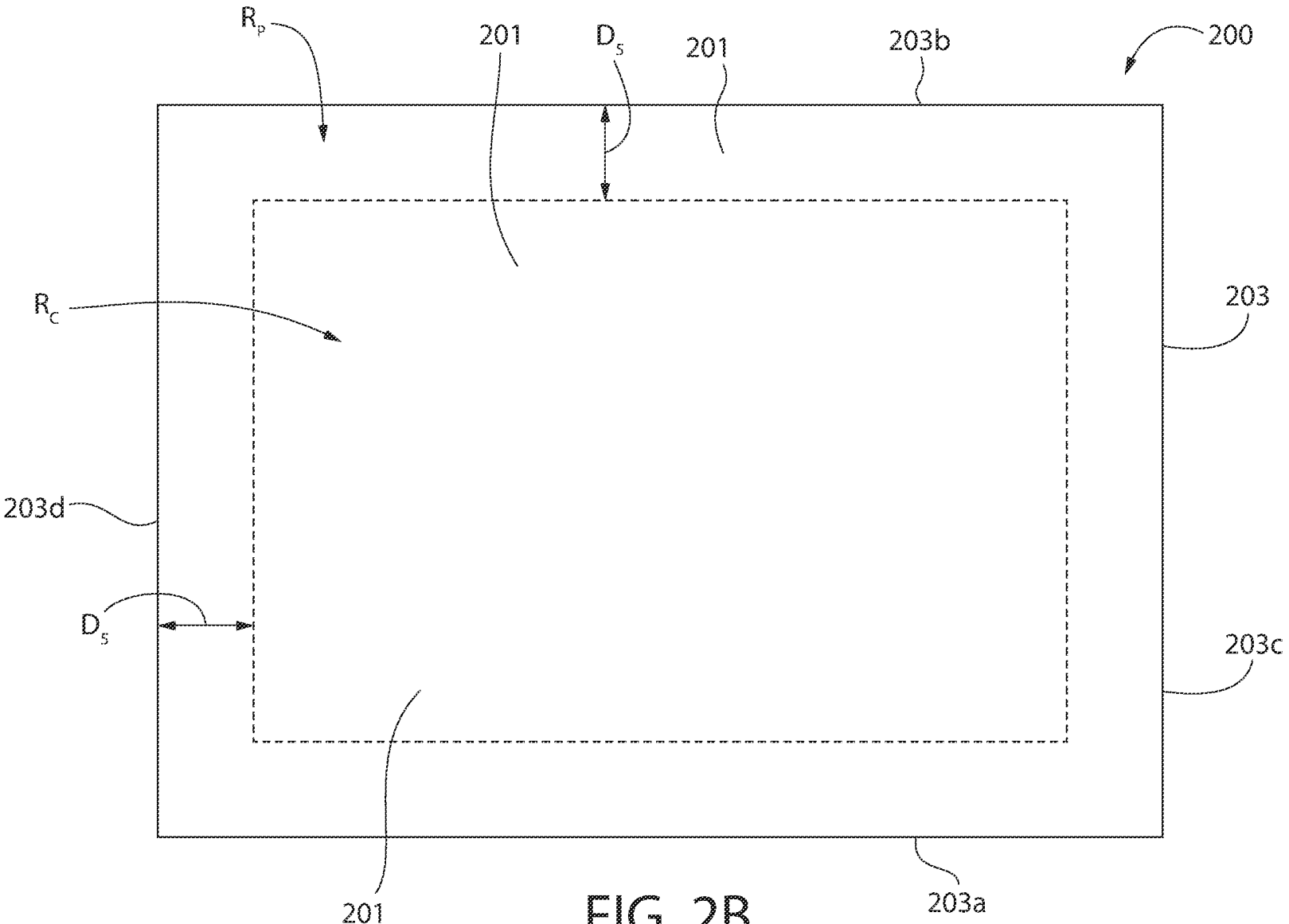
FIG. 2B is top view of the second building panel of FIG. 2A.

Referring now to FIGS. 2A and 2B, the second building panel 200 (also referred to as a "facing building panel") may comprise a first major surface 201 opposite a second major surface 202 and a side surface 203 extending between the first and second major surfaces 201, 202.

The side surface 203 of the second building panel 200 may define a perimeter of the second building panel 200. The side surface 203 of the second building panel 200 may define a perimeter of the first major surface 201 of the second building panel 200. The side surface 203 of the second building panel 200 may define a perimeter of the second major surface 202 of the second building panel 200.

Depending on the shape of the second building panel 200, there may be a plurality of side surfaces 203. The second building panel 200 may be rectilinear in shape. The second building panel 200 may be elongated and extend along a second longitudinal axis B-B.

According to such embodiments, the side surface 203 of the second building panel 200 may comprise a first side surface 203*a*, a second side surface 203*b*, a third side surface 203*c*, and a fourth side surface 203*d*. The first side surface 203*a* may be substantially parallel to the second side surface 203*b*. The third side surface 203*c* may be substantially parallel to the fourth side surface 203*c*. The first side surface 203*a* and the second side surface 203*b* may intersect the third side surface 203*c* and the fourth side surface 203*d*. The first side surface 203*a* and the second side surface 203*b* may each be substantially orthogonal to each of the third side surface 203*c* and the fourth side surface 203*d*.

The second longitudinal axis B-B may intersect the third side surface 203*c* and the fourth side surface 203*d*. The second longitudinal axis B-B may extend substantially parallel to the first side surface 203*a* and the second side surface 203*b*. The second longitudinal axis B-B may extend substantially orthogonal to the third side surface 203*c* and the fourth side surface 203*d*.

The first side surface 203*a* may be referred to as a first elongated side surface or a first elongated edge. The second side surface 203*b* may be referred to as a second elongated side surface or a second elongated edge. The third side surface 203*c* may be referred to as a first transverse side surface or a first transverse edge. The fourth side surface 203*d* may be referred to as a second transverse side surface or a second transverse edge.

The second building panel 200 may have a second thickness $t_2$ as measured from the first major surface 201 to the second major surface 202 of the second building panel 200. The second thickness $t_2$ may range from about 0.4 inches to about 1.6 inches—including all thicknesses and sub-ranges there-between. In some embodiments, the second thickness $t_2$ may range from about 0.75 inches to about 1.0 inch—including all lengths and sub-ranges there-between. In some embodiments, the second thickness $t_2$ is about 0.88 inches.

The second building panel 200 may have a second length $L_2$ as measured from the third side surface 203*c* to the fourth side surface 203*d*. The second length $L_2$ may range from about 60 inches to about 84 inches—including all lengths and sub-ranges there-between. In some embodiments, the second length $L_2$ may range from about 70 inches to about 74 inches—including all lengths and sub-ranges there-between. In some embodiments, the second length $L_2$ is about 72 inches.

The second building panel 200 may have a second width $W_2$ as measured from the first side surface 203*a* to the second side surface 203*b*. The second width $W_2$ may range from about 36 inches to about 60 inches—including all widths and sub-ranges there-between. In some embodiments, the second width $W_2$ may range from about 46 inches to about 50 inches—including all widths and sub-ranges there-between. In some embodiments, the second width $W_2$ is about 48 inches.

The first major surface 201 of the second building panel 200 may comprise a central region $R_C$ and a perimeter region $R_P$. The central region $R_C$ may be at least partially circumscribed by the perimeter region $R_P$. The central region $R_C$ may be fully circumscribed by the perimeter region $R_P$. The perimeter region $R_P$ may extend from the central region $R_C$ to the perimeter of the second building panel 200 (the perimeter of the second building panel 200 being located at the intersection of the side surface 203 and the first major surface 201 of the second building panel 200). The perimeter region $R_P$ may extend from the central region $R_C$ to the perimeter of the second building panel 200 by a perimeter distance $D_5$.

The perimeter distance $D_5$ may range from about 0.5 inches to about 6.0 inches—including all distances and sub-ranges there-between. According to the embodiments, of FIGS. 3A and 4A, the perimeter distance $D_5$ may range from about 3.5 inches to about 4.5 inches—including all distances and sub-ranges there-between. According to the embodiments, of FIGS. 3B and 4B, the perimeter distance $D_5$ may range from about 0.5 inches to about 1.0 inches—including all distances and sub-ranges there-between.

The first major surface 201 of the second building panel 200 may occupy a first surface area. The central region $R_C$ of the first major surface 201 of the second building panel 200 may occupy a second surface area. The perimeter region $R_P$ of the first major surface 201 of the second building panel 200 may occupy a third surface area. The summation of the second surface area and the third surface area may be substantially equal to the first surface area. Stated otherwise, the third surface area may be equal to the difference between the first surface area and the second surface area.

The second surface area may range from about 3% to about 30% of the first surface area—including all percentages and sub-ranges there-between. According to the embodiments, of FIGS. 3A and 4A, the second surface area may range from about 20% to about 30% of the first surface area—including all percentages and sub-ranges there-between. According to the embodiments, of FIGS. 3A and 4A, the second surface area may range from about 24% to about 26% of the first surface area—including all percentages and sub-ranges there-between. According to the embodiments, of FIGS. 3B and 4B, the second surface area may range from about 3% to about 10% of the first surface area—including all percentages and sub-ranges there-between. According to the embodiments, of FIGS. 3B and 4B, the second surface area may range from about 3% to about 7% of the first surface area—including all percentages and sub-ranges there-between.

The second building panel 200 may comprise a second body 210. In some embodiments, the second building panel 200 may comprise a non-woven scrim 220. The non-woven scrim 220 may be bonded to the second body 210 such that the non-woven scrim 220 forms the first major surface 201 of the second building panel 200. The second body 210 may form the second major surface 202 of the second building panel 200. The second body 210 may form the side surface 203 of the second building panel 200.

The second body 210 may be a fibrous body. The second body 210 may be comprised of a binder and fibers. In some embodiments, the second body 210 may further comprise a filler and/or additive. Non-limiting examples of filler may include powders of calcium carbonate, limestone, titanium dioxide, sand, barium sulfate, clay, mica, dolomite, silica, talc, perlite, polymers, gypsum, wollastonite, expanded-perlite, calcite, aluminum trihydrate, pigments, zinc oxide, or zinc sulfate.

The fibers may be organic fibers, inorganic fibers, or a blend thereof. Non-limiting examples of inorganic fibers mineral wool (also referred to as slag wool), rock wool, stone wool, and glass fibers. Non-limiting examples of organic fiber include fiberglass, cellulosic fibers (e.g. paper fiber—such as newspaper, hemp fiber, jute fiber, flax fiber, wood fiber, or other natural fibers), polymer fibers (including polyester, polyethylene, aramid—i.e., aromatic polyamide, and/or polypropylene), protein fibers (e.g., sheep wool), and combinations thereof.

Non-limiting examples of binder may include a starch-based polymer, polyvinyl alcohol (PVOH), a latex, polysaccharide polymers, cellulosic polymers, protein solution polymers, an acrylic polymer, polymaleic anhydride, epoxy resins, or a combination of two or more thereof.

The second body 210 may be porous, thereby allowing airflow through the second body 210 between the first major surface 201 and the second major surface 202 of the second body 210. According to the present invention, the term porous refers to the second body 210 having open pathways sufficient for enough airflow through the second body 210 (under atmospheric conditions) for the second body 210 and the resulting second building panel 200 to function as an acoustic building panel and corresponding acoustic building system 1, which requires properties related to noise reduction and sound attenuation properties—as discussed further herein.

Specifically, the second body 210 of the present invention may have a porosity ranging from about 60% to about 98%—including all values and sub-ranges there between. In a preferred embodiment, the second body 210 has a porosity ranging from about 75% to 95%—including all values and sub-ranges there between.

According to the embodiments where the second body 210 is formed from binder and fibers, porosity may be calculated by the following:

$$\%\ \text{Porosity}=[V_{Total}-(V_{Binder}+V_F+V_A+V_{Filler})]/V_{Total}$$

Where $V_{Total}$ refers to the total volume of second body 210 defined by a first major surface of the second body 210, a second major surface of second body 210, and a side surface of second body 210. $V_{Binder}$ refers to the total volume occupied by the binder in the second body 210. $V_F$ refers to the total volume occupied by the fibers in the second body 210. $V_{Filler}$ refers to the total volume occupied by the filler in the second body 210. $V_A$ refers to the total volume occupied by additives in the second body 210. Thus, the % porosity represents the amount of free volume within the second body 210.

The second body 210 of the present invention may exhibit sufficient airflow for the second building panel 200 to have the ability to reduce the amount of reflected sound in an active room environment 2. The reduction in amount of reflected sound in an active room environment 2 is expressed by a Noise Reduction Coefficient (NRC) rating as described in American Society for Testing and Materials (ASTM) test method C423. This rating is the average of sound absorption coefficients at four ¼ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection.

The second body 210 of the present invention exhibits an NRC of at least about 0.5. In a preferred embodiment, the second body 210 of the present invention may have an NRC ranging from about 0.60 to about 0.99—including all value and sub-ranges there-between. The second building panel 200 of the present invention exhibits an NRC of at least about 0.5. In a preferred embodiment, the second building panel 200 of the present invention may have an NRC ranging from about 0.60 to about 0.99—including all value and sub-ranges there-between.

In addition to reducing the amount of reflected sound in a single active room environment 2, the second body 210—and resulting second building panel 200—of the present invention may also be able to exhibit superior sound attenuation—which is a measure of the sound reduction between an active room environment 2 and a plenary space 3. The ASTM has developed test method E1414 to standardize the measurement of airborne sound attenuation between room environments 2 sharing a common plenary space 3. The rating derived from this measurement standard is known as the Ceiling Attenuation Class (CAC). Ceiling materials and systems having higher CAC values have a greater ability to reduce sound transmission through the plenary space 3—i.e. sound attenuation function.

The second body 210 of the present invention may exhibit a CAC value of 30 or greater, preferably 35 or greater. The second building panel 200 of the present invention may exhibit a CAC value of 30 or greater, preferably 35 or greater.

The second building panel 200 of the present invention may have a second density. The second density may range from about 2 lb./ft$^3$ to about 16 lb./ft$^3$—including all densities and sub-ranges there-between. In some embodiments, the second density may range from about 5 lb./ft$^3$ to about 14 lb./ft$^3$—including all densities and sub-ranges there-between.

The first density and the second density may not be equal. A ratio of the first density to the second density may range from about 1.5:1 to about 10:1—including all densities and sub-ranges there-between. In some embodiments, the ratio of the first density to the second density may be at least 2:1, preferably 3:1. In some embodiments, the ratio of the first density to the second density may be about 4:1.

The first thickness $t_1$ of the first building panel 100 and the second thickness $t_2$ of the second building panel 200 may not be equal. A ratio of the second thickness $t_2$ to the first thickness $t_1$ may range from about 3.0:1 to about 1.25:1—including all ratios and sub-ranges there-between. In some embodiments, the ratio of the second thickness $t_2$ to the first thickness $t_1$ may be about 2.3:1. In some embodiments, the ratio of the second thickness $t_2$ to the first thickness $t_1$ may be about 1.8:1. In some embodiments, the ratio of the second thickness $t_2$ to the first thickness $t_1$ may be about 1.4:1.

A ratio of the first length $L_1$ to the second length $L_2$ may range from about 3.0:1 to about 1.2:1—including all ratios and sub-ranges there-between. In some embodiments, the ratio of the first length $L_1$ to the second length $L_2$ may be about 2:1. In some embodiments, the ratio of the first length $L_1$ to the second length $L_2$ may be about 1.7:1. In some embodiments, the ratio of the first length $L_1$ to the second length $L_2$ may be about 1.3:1.

Referring now to FIGS. 3A, 4A, 5A, 6, 7, 8A, and 8B a building system 1 may comprise a plurality of the first building panels 100 and a plurality of the second building panels 200. Each of the plurality of first building panels 100 may be secured to the support member 50. Each of the plurality of first building panels 100 may be secured directly to the support member 50. Specifically, each of the plurality of first building panels 100 may be secured to the support face 51 of the support member 50. Each of the plurality of first building panels 100 may be directly secured to the support face 51 of the support member 50.

Each of the plurality of first building panels 100 may be secured to the support member 50 by a mechanical fastener 400. In other embodiments, each of the plurality of first building panels 100 may be secured to the support member 50 by an adhesive (not pictured).

During installation, each of the plurality of first building panels 100 may be positioned such that the second major surface 102 of the first building panel 100 faces the support surface 51 of the support member 50. In the embodiment shown in FIGS. 3 and 4, the second major surface 102 of the first building panel 100 faces upward toward the plenary space 3. According to embodiments where the building system is a wall system, the second major surface 102 may be horizontally oriented and face away from the active room environment 2 (not pictured).

During installation, each of the plurality of first building panels 100 may be positioned such that the first major surface 101 of the first building panel 100 faces away from the support surface 51 of the support member 50. In the embodiment shown in FIGS. 3 and 4, the first major surface 101 of the first building panel 100 faces downward toward the active room environment 2. According to embodiments where the building system is a wall system, the first major surface 101 may be horizontally oriented and face toward from the active room environment 2 (not pictured).

A first interface 60 may exist between the overlapping space that exists between the second major surface 102 of the first building panel 100 and the support surface 51 of the support member 50. The first interface 60 may comprise adhesive 300. One or more of the mechanical fastener 400 may extend through the first interface 60.

In some embodiments, the first interface 60 may be substantially free of adhesive. The term "substantially free of adhesive" refers to an amount of adhesive present in the first interface 60 that is not sufficient for the adhesive to physically bond the first building panel 100 to the support member 50 under the effects of gravity. Therefore, the term "substantially free of adhesive" may include a first interface 60 that is entirely free of adhesive or may include minor amounts of adhesive that is not sufficient alone to physically secure the first building panel 100 to the support member 50. In some embodiments, the first interface 60 may be entirely free of adhesive.

Once secured to the support members 50, the plurality of first building panels 100 may form a pre-existing building layer 80. Each of the plurality of second building panels 200 may be secured to the pre-existing building layer 80 by one or more fasteners 400. Each of the plurality of second building panels 200 may be secured directly to the pre-existing building layer 80. Specifically, each of the plurality of second building panels 200 may be secured to one or more of the first building panel 100. Each of the plurality of second building panels 200 may be directly secured to one or more of the first building panels 100.

While the present invention provides for the installation and formation of the pre-existing building layer 80, the present invention is not limited to such installation steps. Rather, other embodiments of the present invention may not require the separate step of installing the plurality of first building panels 100 as the pre-existing building layer 80 may already be present in a room environment—according to such embodiments, the plurality of second building panels 200 may be retro-fit to a pre-existing building layer 80.

Each of the plurality of second building panels 200 may be secured to the pre-existing building layer 80 by mechanical fastener 400. Each of the plurality of second building panels 200 may be secured to the pre-existing building layer 80 by adhesive 300. Each of the plurality of second building panels 200 may be secured to one or more of the first building panels 100 by mechanical fastener 400. Each of the plurality of second building panels 200 may be secured to one or more of the first building panels 100 by adhesive 300. The plurality of second building panels 200 installed adjacent to each other may form a facing layer 90.

In the installed state, each of the plurality of second building panels 200 may be positioned such that the second major surface 202 of the second building panel 200 faces the first major surface 101 of the first building panels 100. In the embodiment shown in FIGS. 3A and 4A, the second major surface 202 of the second building panel 200 faces upward. According to embodiments where the building system is a wall system, the second major surface 202 of the second building panel 200 may be horizontally oriented and face away from the active room environment 2 (not pictured).

In the installed state, each of the plurality of second building panels 200 may be positioned such that the first major surface 201 of the second building panel 200 faces away from the support surface 51 of the support member 50. In the embodiment shown in FIGS. 3A and 4A, the first major surface 201 of the second building panel 300 faces downward toward the active room environment 2. According to embodiments where the building system is a wall system, the first major surface 201 may be horizontally oriented and face toward from the active room environment 2 (not pictured).

A second interface 70 may exist between the overlapping space that exists between the second major surface 202 of the second building panel 200 and the first major surface 101 of the first building panel 100. The second interface 70 may comprise adhesive. One or more of the mechanical fastener 400 may extend through the second interface 70.

The mechanical fasteners 400 may comprise a plurality of first mechanical fasteners 410 and a plurality of second mechanical fastener 420. The plurality of second building panels 200 may be secured to the pre-existing building layer 80 by the plurality of first mechanical fasteners 410. The plurality of second building panels 200 may be secured to one or more of the first building panels 200 by the plurality of first mechanical fasteners 410. The plurality of first building panels 100 may be secured to the securing members 50 by the plurality of second mechanical fasteners 420.

Each of the plurality of first mechanical fasteners 410 may comprise a head 411 and a threaded body 412. Each of the plurality of first mechanical fasteners 410 may extend a first fastener length $L_{F1}$ as measured from a proximal end 413 of the head 411 to a distal end 414 of the threaded body 412 of the first mechanical fastener 410. The head 411 of each of the first mechanical fasteners 410 may have an outer diameter $D_4$.

Each of the plurality of second mechanical fasteners 420 may comprise a head 421 and a threaded body 422. Each of the plurality of second mechanical fasteners 420 may extend a second fastener length that is measured from a proximal end 423 of the head 421 to a distal end 424 of the threaded body 422 of the second mechanical fastener 420. The second fastener length may be substantially equal to the first fastener length $L_{F1}$. In some embodiments, the second fastener length may be greater than the first fastener length $L_{F1}$.

The first fastener length $L_{F1}$ may range from about 1 inch to about 2.5 inches—including all lengths and sub-ranges there-between. In some embodiments, the first fastener length $L_{F1}$ may range from about 1 inch to about 2 inches—including all lengths and sub-ranges there-between.

The first fastener length $L_{F1}$ may be less than the summation of the first thickness $t_1$ of the first building panel and the second thickness $t_2$ of the second building panel $t_2$. In some embodiments, the first fastener length $L_{F1}$ may be substantially equal to the summation of the first thickness $t_1$ of the first building panel and the second thickness $t_2$ of the second building panel $t_2$. In some embodiments, the first fastener length $L_{F1}$ may be greater than the summation of the first thickness $t_1$ of the first building panel and the second thickness $t_2$ of the second building panel $t_2$.

A ratio of the first fastener length $L_{F1}$ to the first thickness $t_1$ of the first building panel 100 may range from about 1.25:1 to about 2.5:1—including all ratios and sub-ranges there-between. In some embodiments, the ratio of the first fastener length $L_{F1}$ to the first thickness $t_1$ of the first building panel 100 may range from about 1.5:1 to about 2.0:1—including all ratios and sub-ranges there-between.

The outer diameter $D_4$ of the head 411 of the first mechanical fastener 410 may range from about 0.3 inch to about 0.38 inches—including all diameters and sub-ranges there-between. In some embodiments, the outer diameter $D_4$ of the head 411 of the first mechanical fastener 410 may range from about 0.31 inch to about 0.35 inches—including all diameters and sub-ranges there-between.

A ratio of the first fastener length $L_{F1}$ to the outer diameter $D_4$ of the first mechanical fastener 410 may range from about 6:1 to about 4:1—including all ratios and sub-ranges there-between. In some embodiments, the ratio of the first fastener length $L_{F1}$ to the outer diameter $D_4$ of the first mechanical fastener 410 may range from about 5.5:1 to about 4.25:1—including all ratios and sub-ranges there-between.

In securing the second building panel 200 to the pre-existing building layer 80, at least one of the plurality of first fasteners 410 may be driven into the second building panel 200 such that the head 411 of the first fastener 410 is located inset of the first major surface 201 of the second building panel 200. State otherwise, in securing the second building panel 200 to one or more of the first building panel 100, at least one of the plurality of first fasteners 410 may be driven into the second building panel 200 such that the head 411 of the first fastener 410 is located inset of the first major surface 201 of the second building panel 200.

At least one of the plurality of first fasteners 410 may be driven into the second building panel 200 such that the head 411 is entirely positioned between the first major surface 201 and the second major surface 202 of the second building panel 200. At least one of the plurality of first fasteners 410 may be driven into the second building panel 200 such that the head 411 of the first fastener 410 does not overlap with the second major surface 201 of the second building panel 200. At least one of the plurality of first fasteners 410 may be driven into the second building panel 200 such that the proximal end of the head 411 is inset from the first major surface 201 of the second building panel 200 by a first depth $D_1$. The first depth $D_1$ may range from about 1% to about 30% the second thickness $t_2$ of the second building panel 200—including all percentages and sub-ranges there-between.

In securing the second building panel 200 to the pre-existing building layer 80, at least one of the plurality of first fasteners 410 may be driven into the second building panel 200 such that at least a portion of the threaded body 412 of the first fastener 410 is located inset of the first major surface 201 of the second building panel 200. In securing the second building panel 200 to the pre-existing building layer 80, at least one of the plurality of first fasteners 410 may be driven into the second building panel 200 such that at least a portion of the threaded body 412 of the first fastener 410 is located between the first major surface 201 and the second major surface 202 of the second building panel 200.

In securing the second building panel 200 to one or more of the first building panel 100, at least one of the plurality of first fasteners 410 may be driven into the second building panel 200 such that at least a portion of the threaded body 412 of the first fastener 410 is located inset of the first major surface 201 of the second building panel 200. In securing the second building panel 200 to one or more of the first building panel 100, at least one of the plurality of first fasteners 410 may be driven into the second building panel 200 such that at least a portion of the threaded body 412 of the first fastener 410 is located between the first major surface 201 and the second major surface 202 of the second building panel 200.

In securing the second building panel 200 to one or more of the first building panel 100, at least one of the plurality of first fasteners 410 may be driven into the second building panel 200 such that at least a portion of the threaded body 412 passes through adhesive 300 present in the second interface 70. According to such embodiments, the first fastener 410 may bring together the first building panel 100 and the second building panel 200 where the adhesive 300 is located, thereby spreading the adhesive 300 within the second interface 70 to ensure a strong adhesive bond therein.

In securing the first building panel 100 to the securing member 50, at least one of the plurality of second fasteners 420 may be driven into the first building panel 100 such that the head 421 of the second fastener 420 is at least substantially flush with the first major surface 101 of the first building panel 100. In some embodiments, in securing the first building panel 100 to the securing member 50, at least one of the plurality of second fasteners 420 may be driven into the first building panel 100 such that the head 421 of the second fastener 420 is inset of the first major surface 101 of the first building panel 100.

In securing the first building panel 100 to the securing member 50, at least one of the plurality of second fasteners 420 may be driven into the first building panel 100 such that at least a portion of the threaded body 422 of the second fastener 420 is located inset of the first major surface 101 of the first building panel 100. In securing the first building panel 100 to the securing member 50, at least one of the plurality of second fasteners 420 may be driven into the first building panel 100 such that at least a portion of the threaded body 422 of the second fastener 420 is located between the first major surface 101 and the second major surface 102 of the first building panel 100.

In securing the first building panel 100 to one or more of the securing members 50, at least one of the plurality of second fasteners 420 may be driven into the securing member 50 such that at least a portion of the threaded body 422 of the second fastener 420 is located inset of the support surface 51 of the securing member 50.

At least a portion of the threaded body 422 of one of the plurality of the second fasteners 420 may extend through the first interface 60. In some embodiments, the threaded body 422 of at least one of the plurality of second fasteners 420 may not extend through the second interface 70.

The plurality of second fasteners 420 may be located inset of the side surfaces 103 of the first building panel 100—whereby the plurality of second mechanical fasteners 420 contact a single one of the first building panel 100.

At least a portion of the threaded body 412 of one of the plurality of the first fasteners 410 may extend through the second interface 70. In some embodiments, the threaded body 412 of at least one of the plurality of first fasteners 410 may not extend through the first interface 60.

During installation, the second major surface 202 of at least one of the second building panel 200 is brought into contact with a pre-existing building surface 81 formed by the pre-existing building layer 80 to form the second interface 70, whereby the adhesive 300 is present as the second interface 70 is formed, and the adhesive is in a state where the adhesive 300 has not yet reach full bond strength.

The adhesive may be a reactive adhesive provided in an uncured state—i.e., has not yet reached full bond strength. Non-limiting examples of reactive adhesives include epoxy, polyurethane, and cyanoacrylates—whereby the uncured adhesive may be applied and allowed to react to reach a fully cured state, thereby reaching full bond strength. The adhesive may be a non-reactive adhesive, which may be applied in a first state that has not yet reached full bond strength and allowed to transition into a second state that exhibits full bond strength. Non-limiting examples of non-reactive adhesives include drying adhesives (solvent-based), hot-melt adhesives, and contact adhesives. Drying adhesives may be applied in a wet-state (i.e., first state) and allowed to dry (i.e., second state) to reach full bond strength. Hot-melt adhesives may be applied in a melted-state (i.e., first state) and allowed to cool (i.e., second state) to reach full bond strength.

Installation may further comprise driving at least one of the first mechanical fasteners 410 into the at least one second building panel 200 and the first building panel 100. The first mechanical fastener 410 may be driven into the first and second building panels 100, 200 and through the second interface 70 before the adhesive 300 has reached full bond strength. Subsequently, installation may include a time period sufficient for such adhesive 300 to reach full bond strength. After the time period where the adhesive 300 reaches full bond strength, one or more of the plurality of first mechanical fasteners 410 may be removed.

Figure 7:
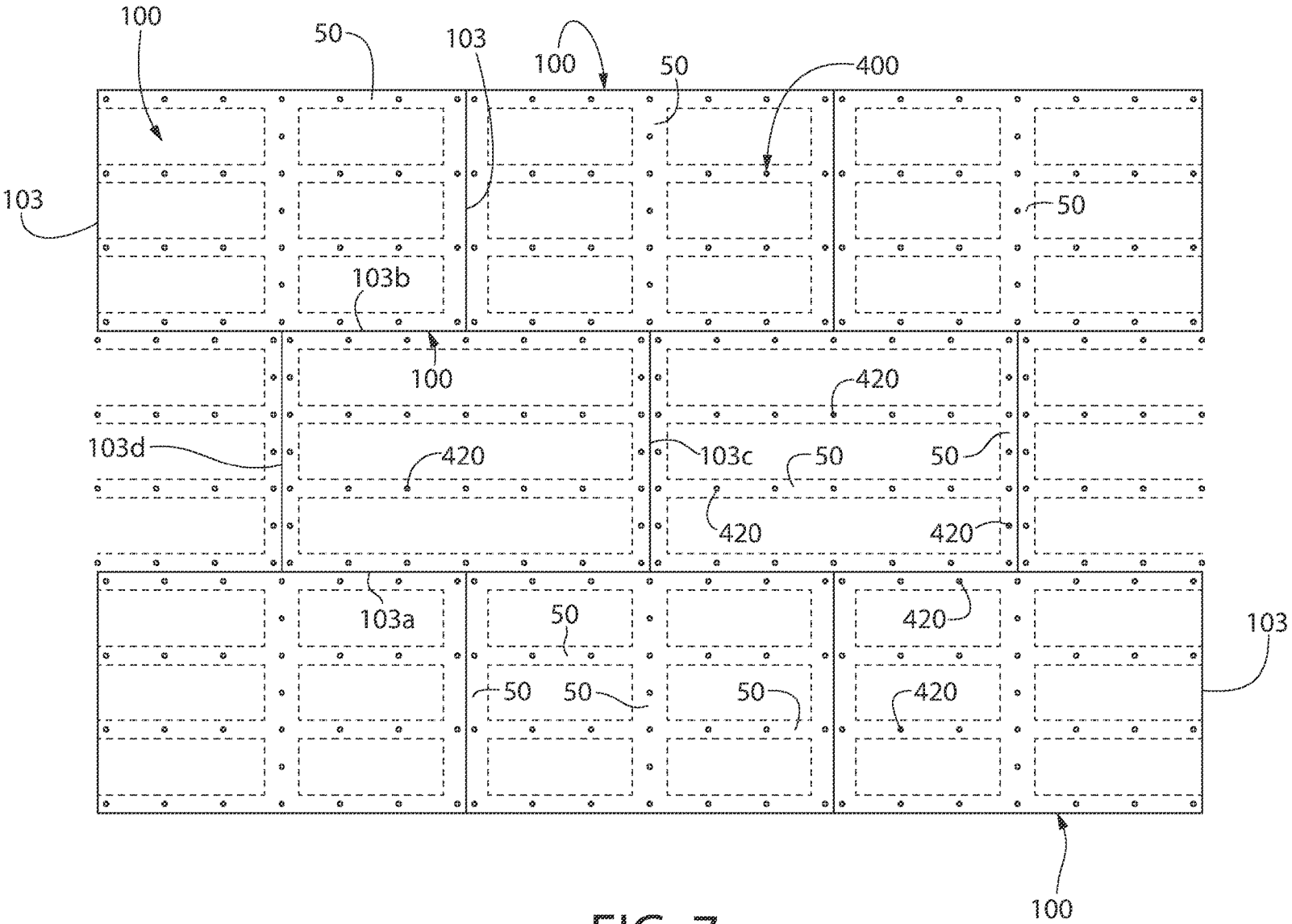
FIG. 7 is an upward view of the first building panel with support members installed into the building system of FIG. 3 being installed.

Referring now to FIG. 7, the thin dotted linear lines represent the support member 50 and the solid lines represent the first building panels 100—the support members 50 are represented by dotted lines so that it may be shown how the plurality of first building panels 100 are oriented relative to the plurality of support members 50 in forming the pre-existing building layer 80.

Figure 8A:
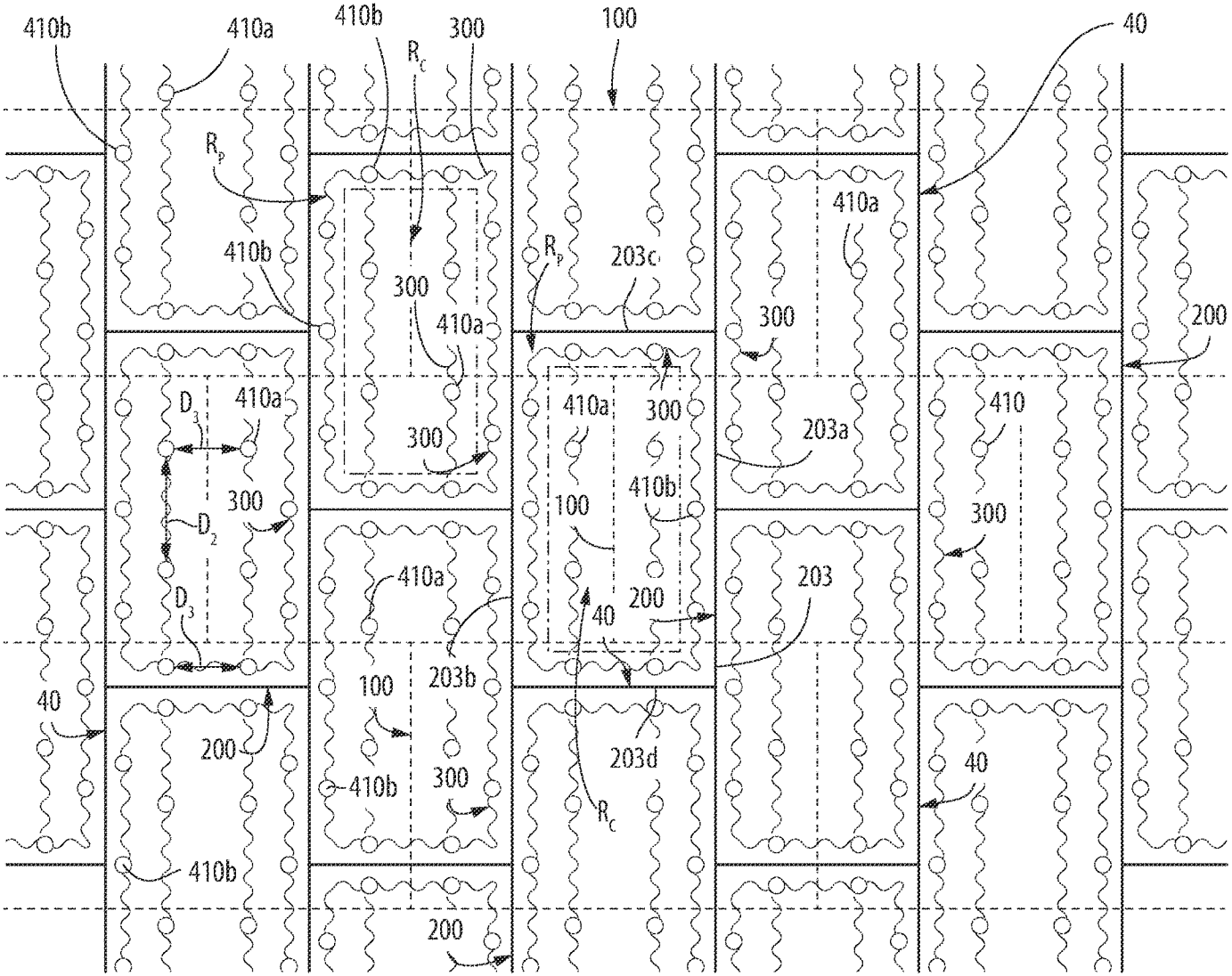
FIG. 8A is an upward view of the second building panel with first building panel of the building system of FIG. 3A being installed according to one embodiment.
Figure 8B:
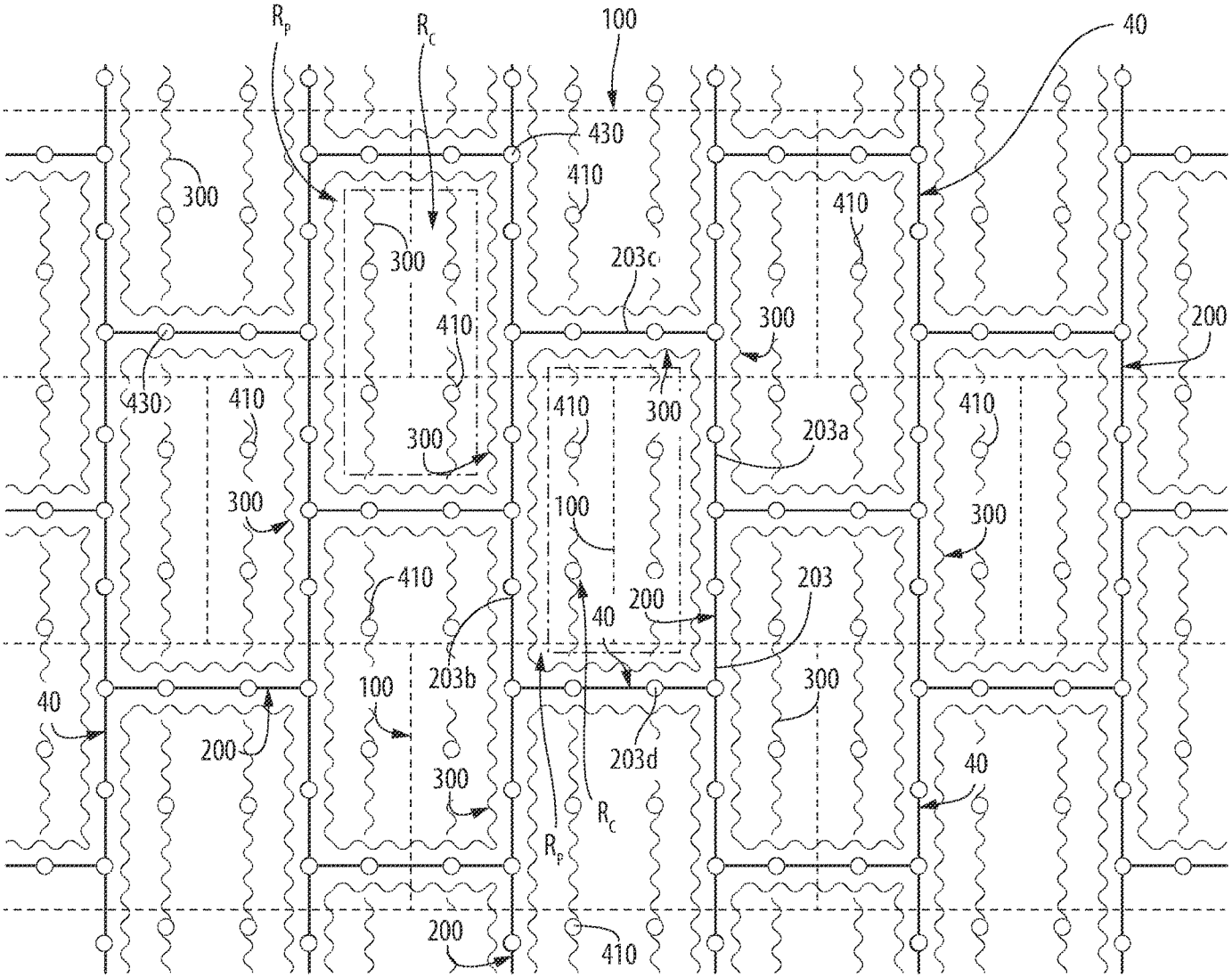
FIG. 8B is an upward view of the second building panel with first building panel of the building system of FIG. 3A being installed according to another embodiment.

Referring now to FIGS. 8A and 8B, the thin dotted linear lines of the same length represent the plurality of first building panels 100, the thin solid linear lines represent the second building panels 200, the thin solid wavy lines represent the adhesive 300, and the dotted-dashed linear lines represent the boundary between the central region $R_C$ and the perimeter region $R_P$ of each second building panel 200. The first building panels 100 are represented by as thin dotted lines so that it may be shown how the plurality of second building panels 200 are oriented relative to the plurality of first building panels 100 in forming the facing layer 90 as well as the orientation of the adhesive 300 within the second interface 70 located between the pre-existing building layer 80 and the facing layer 90.

When installed, the plurality of second building panels 200 and the plurality of first building panels 100 may be arranged in an offset pattern such that at least one of the side surfaces 103 of the first building panel and at least one of the side surfaces 203 of the second building panel are not co-planar.

For each one of the plurality of second building panels 200, the plurality of first mechanical fasteners 410 may be separated by a longitudinal separation distance $D_2$ and a lateral separation distance $D_3$. The longitudinal separation distance $D_2$ is the distance separating the adjacent most first mechanical fasteners along a direction parallel to the second longitudinal axis B-B. The lateral separation distance $D_3$ is the distance separating the adjacent most first mechanical fasteners along a direction orthogonal to the second longitudinal axis B-B.

When installed, at least one of the plurality of first building panels 100 and at least one of the plurality of second building panels 200 are arranged such that the first longitudinal axis A-A and the second longitudinal axis B-B are not parallel. When installed, at least one of the plurality of first building panels 100 and at least one of the plurality of second building panels 200 are arranged such that the first longitudinal axis A-A and the second longitudinal axis B-B are orthogonal.

When installed, the first elongated edge 203*a* of one of the plurality of second building panels 200 may overlap at least a portion of a first one of the plurality of first building panels 100 and a portion of a second one of the plurality of first building panels 100. When installed, the second elongated edge 203*b* of the one of the plurality of second building panels 200 may overlap at least the portion of the first one of the plurality of first building panels 100 and a portion of a third one of the plurality of first building panels 100.

During installation of the second building panels 200, at least one of the first and/or third mechanical fasteners 410, 430 are driven into the edge interface 40 and/or the second building panel 200 before the adhesive 300 has reached full bond strength. Subsequently, installation may include a time period sufficient for such adhesive 300 to reach full bond strength. After the time period where the adhesive 300 reaches full bond strength, one or more of the plurality of third mechanical fasteners 430 may be removed.

For the adhesive 300 present in the second interface 70, the adhesive 300 may be present in longitudinal stripes that are substantially parallel to the second longitudinal axis B-B. For each second building panel 200, there may be at least two stripes of adhesive 300 extending in a direction substantially parallel to the longitudinal axis B-B. Each of the strips of adhesive 300 may be separated by a distance that is substantially equal to the lateral separation distance $D_3$ of the first mechanical fasteners 410.

The plurality of longitudinal strips of the adhesive 300 may continuously span across at least two adjacent ones of the second building panel 200. The plurality of longitudinal stripes of the adhesive 300 may continuously span across at least two adjacent ones of the second building panel 200 in a direction substantially parallel to the second longitudinal axis B-B. The plurality of longitudinal stripes of the adhesive 300 may continuously span across at least three adjacent ones of the second building panel 200 in a direction substantially parallel to the second longitudinal axis B-B.

The plurality of longitudinal stripes of the adhesive 300 may continuously span across at least two adjacent ones of the first building panel 100. The plurality of longitudinal stripes of the adhesive 300 may continuously span across at least two adjacent ones of the first building panel 100 in a direction substantially orthogonal to the first longitudinal axis A-A.

For the adhesive 300 present in the second interface 70, the adhesive 300 may be present in longitudinal strips that are substantially parallel to the second longitudinal axis B-B. For each second building panel 200, there may be at least two stripes of adhesive 300 extending in a direction substantially parallel to the longitudinal axis B-B. Each of the strips of adhesive 300 may be separated by a distance that is substantially equal to the lateral separation distance $D_3$ of the first mechanical fasteners 410.

The plurality of stripes of the adhesive 300 may continuously span across at least two adjacent ones of the second building panel 200. The plurality of stripes of the adhesive 300 may continuously span across at least two adjacent ones of the second building panel 200 in a direction substantially parallel to the second longitudinal axis B-B. The plurality of stripes of the adhesive 300 may continuously span across at least three adjacent ones of the second building panel 200 in a direction substantially parallel to the second longitudinal axis B-B.

The plurality of stripes of the adhesive 300 may continuously span across at least two adjacent ones of the first building panel 100. The plurality of stripes of the adhesive 300 may continuously span across at least two adjacent ones of the first building panel 100 in a direction substantially orthogonal to the first longitudinal axis A-A.

Referring to FIG. 8A, the second building panel 200 may be secured such that a first plurality of the first mechanical fasteners 410*a* are located within the central region $R_C$ of the second building panel 200 and a second plurality of the first mechanical fasteners 410*b* are located within the perimeter region $R_P$ of the second building panel 200.

According to such embodiments, the perimeter region $R_P$ may have a perimeter distance ranging from about 3 inches to about 5 inches—including all distances and subranges there-between. According to such embodiments, the first plurality of first mechanical fasteners 410*a* may be present in the central region $R_C$ an amount ranging from about 4 to about 10—including all integers and sub-ranges there-between. In some embodiments, the first plurality of first mechanical fasteners 410*a* may be present in the central region $R_C$ an amount ranging from about 4 to about 8—including all integers and sub-ranges there-between. According to such embodiments, the first plurality of first mechanical fasteners 410*a* may have a longitudinal separation distance $D_2$ ranging from about 15 inches to about 21 inches—including all distances and subranges there-between. In some embodiments, the first plurality of first mechanical fasteners 410*a* may have a longitudinal separation distance $D_2$ of about 16 inches to about 18 inches.

The first plurality of first mechanical fasteners 410*a* may have a longitudinal separation distance $D_2$ that is equal to about 20% to about 30% the second length $L_2$ of the second building panel 200—including all percentages and subranges there-between.

According to such embodiments, the second plurality of first mechanical fasteners 410*b* may be present in the perimeter region $R_P$ an amount such that the second plurality of first mechanical fasteners 410*b* are separated by longitudinal separation distance $D_2$ and a lateral separation distance $D_3$ ranging from about 6 inches to about 15 inches—including all distances and sub-ranges there-between. The second plurality of first mechanical fasteners 410*b* may have a longitudinal separation distance $D_2$ that is equal to about 8% to about 15% the second length $L_2$ of the second building panel 200—including all percentages and sub-ranges there-between.

According to such embodiments, where adhesive 300 is present in the second interface 70, the first plurality of first mechanical fasteners 410*a* and the second plurality of first mechanical fasteners 410*b* should extend through the adhesive 300.

The first plurality of first mechanical fastener 410*a* may be present in a first fastener density. The first fastener density may be calculated as the total number of the first plurality of first mechanical fasteners 410*a* that are located within the first surface area of the first major surface 201 of the second building panel 200. The second plurality of first mechanical fastener 410*b* may be present in a second fastener density. The second fastener density may be calculated as the total number of the second plurality of first mechanical fasteners 410*b* that are located within the first surface area of the first major surface 201 of the second building panel 200.

The first fastener density and the second fastener density may not be equal. The second fastener density may be greater than the first fastener density. The first fastener density may range from about 0.15 fasteners/$ft^2$ to about 0.5 fasteners/$ft^2$—including all densities and sub-ranges there-between. The second fastener density may range from about 0.6 fasteners/$ft^2$ to about 1.3 fasteners/$ft^2$—including all densities and sub-ranges there-between. A ratio of the second fastener density to the first fastener density may range from about 1.2:1 to about 8.6:1—including all ratios and sub-ranges there-between.

Referring now to FIG. 8B, an alternative to the embodiment of FIG. 8A is shown, whereby the plurality of second building panels 200 and may be secured by a plurality of the first mechanical fasteners 410 and a plurality of a third mechanical fasteners 430. According to this embodiment, the second building panel 200 may be secured such that the plurality of the first mechanical fasteners 410 are located within the central region $R_C$ of the second building panel 200 and a plurality of the third mechanical fasteners 430 along the edge interface 40 of adjacent second building panels 200.

According to such embodiments, the perimeter region $R_P$ may be free of the first mechanical fastener 410 whereby only the central region $R_C$ comprises the first mechanical fastener 410. In other embodiments, the perimeter region $R_P$ may comprise one or more of the first mechanical fastener 410.

For the third mechanical fasteners 430 located along the edge interface 40, the lateral separation distance $D_3$ may range from about 8 inches to about 30 inches—including all distances and sub-ranges there-between.

Referring to FIG. 8B, the building system 1 may comprise the second building panel 200 secured to the preexisting building layer 80 by both the plurality of first mechanical fasteners 410 and a plurality of third mechanical fasteners 430 as well as adhesive 300.

The third mechanical fastener 430 may comprise a head and a threaded body. Each of the plurality of third mechanical fasteners 430 may extend a third fastener length as measured from a proximal end of the head to a distal end of the threaded body of the third mechanical fastener 430. The head of each of the third mechanical fasteners 430 may have an outer diameter.

The third fastener length may range from about 1 inch to about 2.5 inches—including all lengths and sub-ranges there-between. The third fastener length may be less than the summation of the first thickness $t_1$ of the first building panel and the second thickness $t_2$ of the second building panel $t_2$. In some embodiments, the third fastener length may be substantially equal to the summation of the first thickness $t_1$ of the first building panel and the second thickness $t_2$ of the second building panel $t_2$. In some embodiments, the third fastener length may be greater than the summation of the first thickness $t_1$ of the first building panel and the second thickness $t_2$ of the second building panel $t_2$.

A ratio of the third fastener length to the first thickness $t_1$ of the first building panel 100 may range from about 1.25:1 to about 2.5:1—including all ratios and sub-ranges there-between. In some embodiments, the ratio of the third fastener length to the first thickness $t_1$ of the first building panel 100 may range from about 1.5:1 to about 2.0:1—including all ratios and sub-ranges there-between.

The outer diameter of the head of the third mechanical fastener 430 may range from about 1.0 inch to about 1.5 inches—including all diameters and sub-ranges there-between. In some embodiments, the outer diameter of the head of the third mechanical fastener 430 may range from about 1.2 inch to about 1.3 inches—including all diameters and sub-ranges there-between.

A ratio of the third fastener length to the outer diameter of the third mechanical fastener 430 may range from about 1:1.1 to about 1.5:1—including all ratios and sub-ranges there-between. In some embodiments, the ratio of the third fastener length to the outer diameter of the third mechanical fastener 430 may range from about 1.2:1 to about 1.4:1—including all ratios and sub-ranges there-between.

At least a portion of the threaded body of one of the plurality of the third fasteners 430 may extend through the second interface 70. In some embodiments, the threaded body of at least one of the plurality of third fasteners 430 may not extend through the first interface 60.

Figure 9:
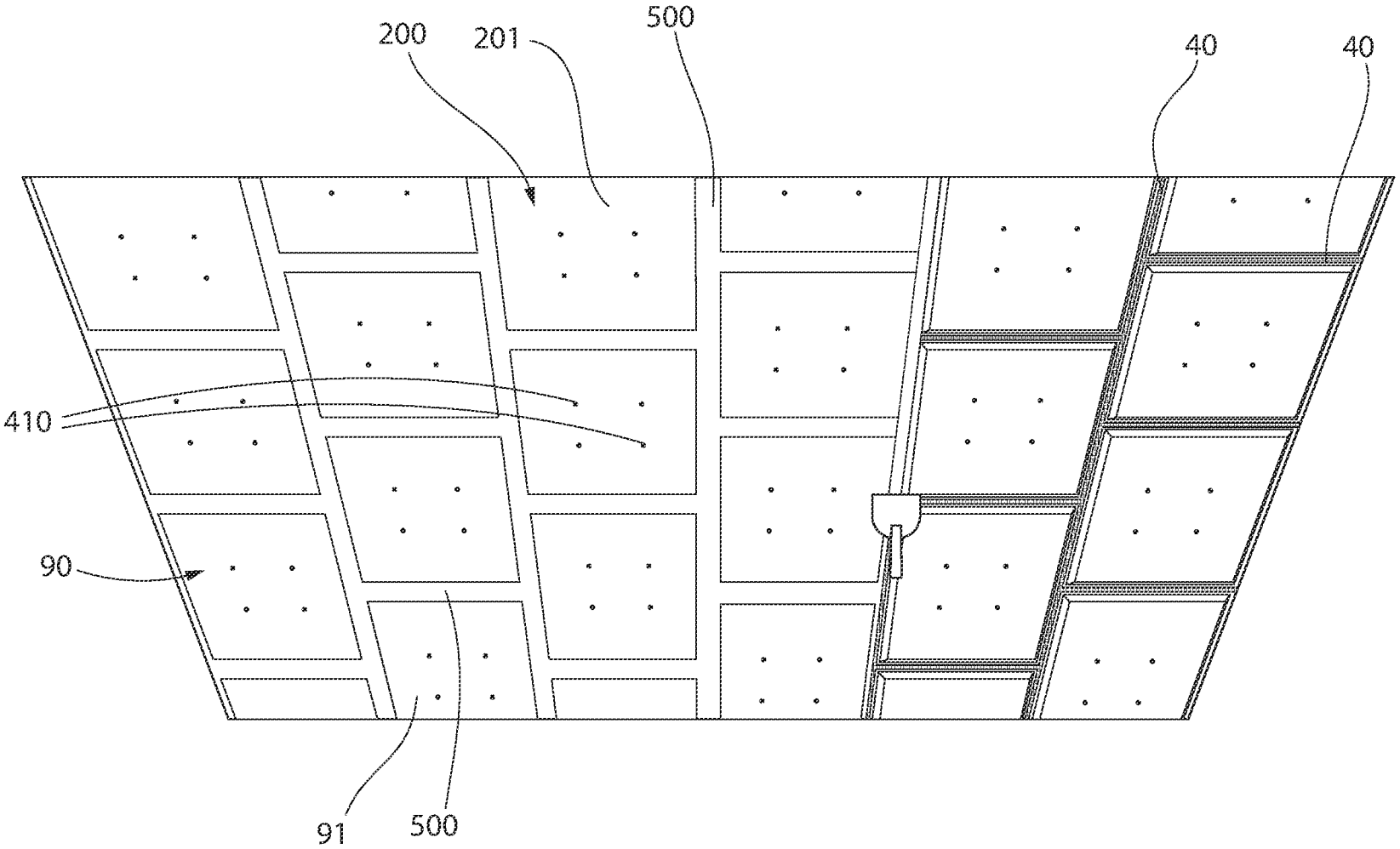
FIG. 9 is an upward facing perspective view of the building system during installation.
Figure 10:
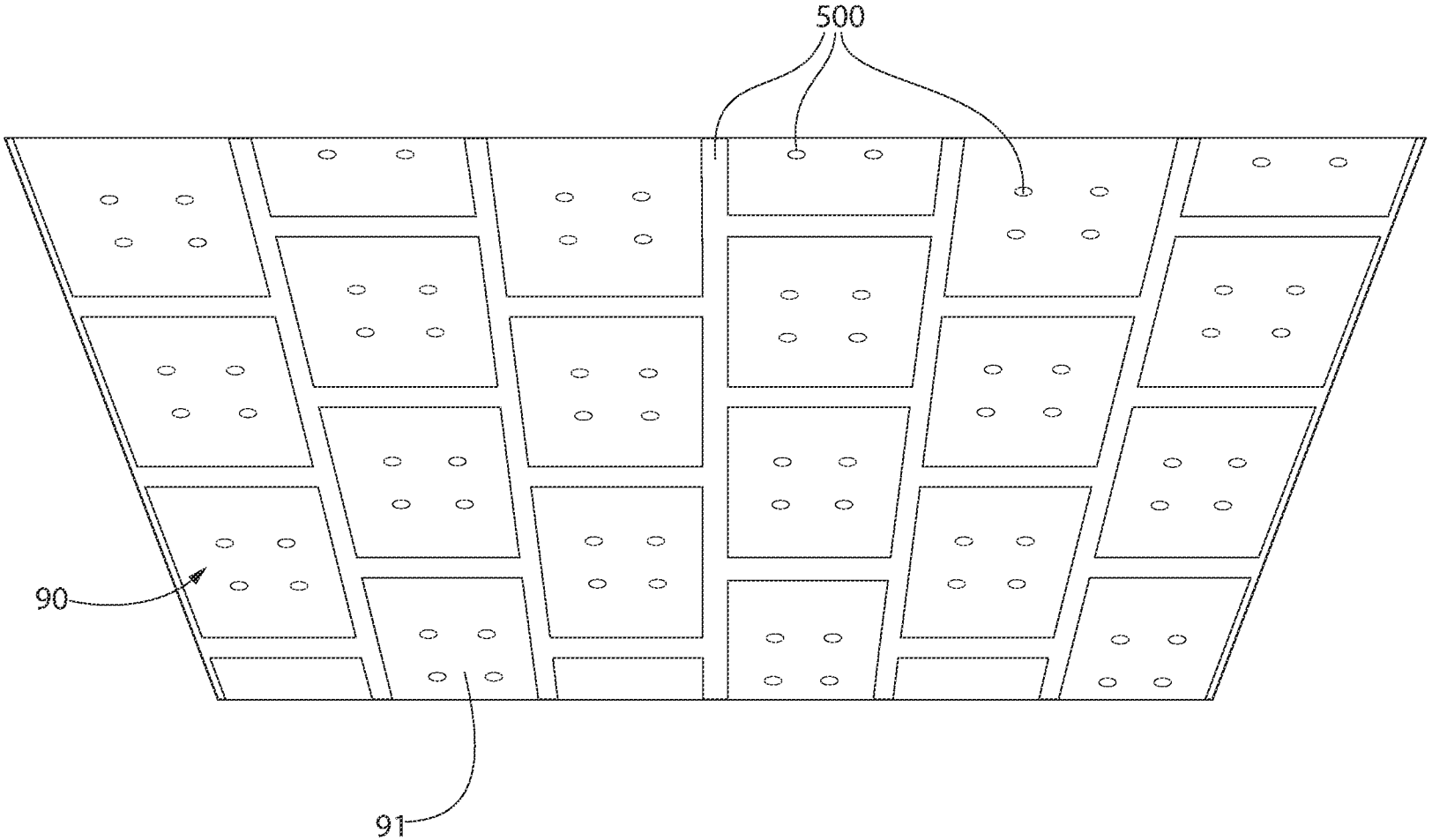
FIG. 10 is an upward facing perspective view of the building system during installation.
Figure 11:
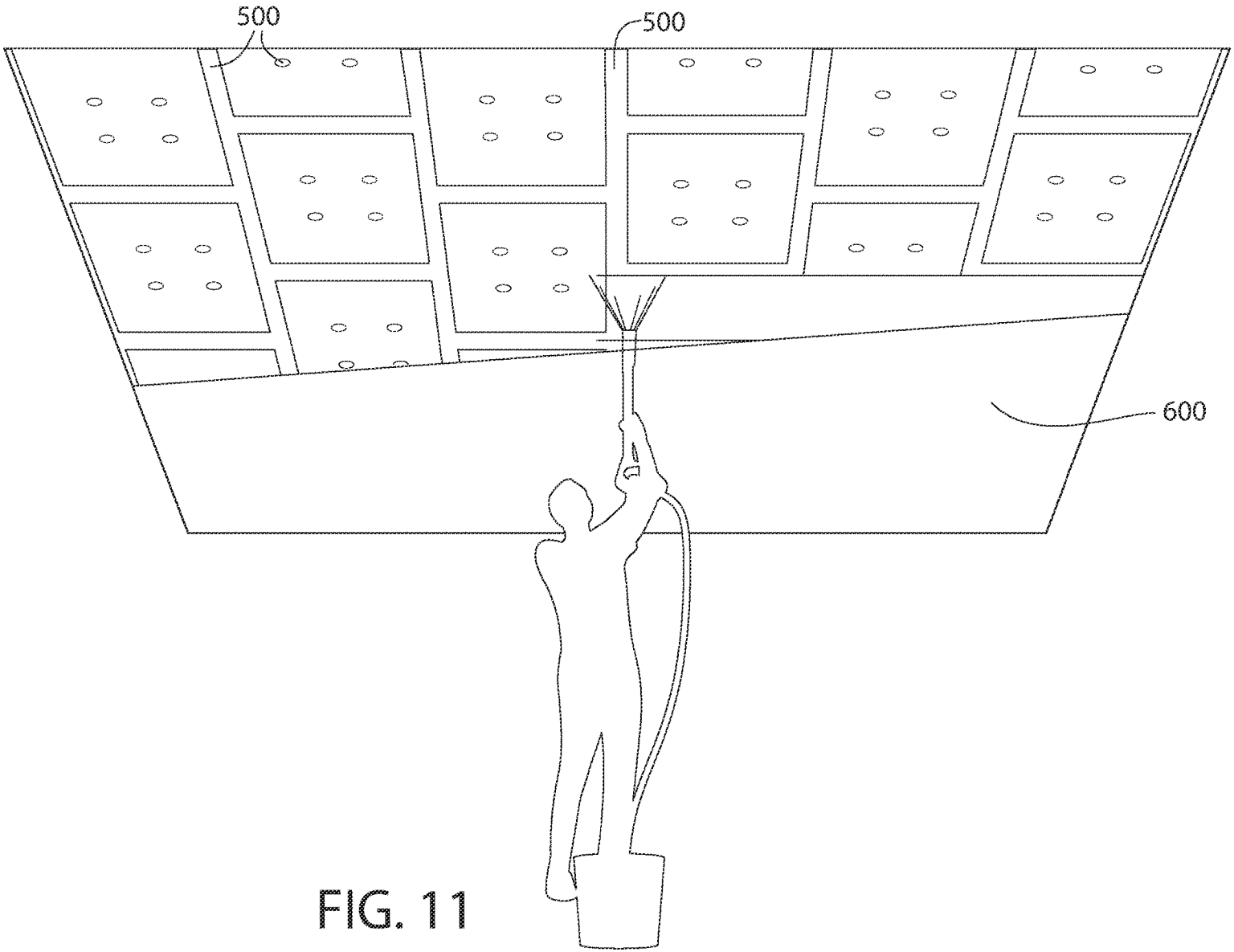
FIG. 11 is an upward facing perspective view of the building system during installation.

Referring now to FIGS. 9-11, once the plurality of second building panels 200 are secured in place by mechanical fastener and adhesive 300, a facing surface 91 of the facing layer 90 may be formed collectively by the first major surfaces of the plurality of second building panels 200. The concealing composition 500 is applied where the plurality of first mechanical fasteners 410 and/or third mechanical fasteners 430—thereby concealing such mechanical fasteners as well as concealing such edge interfaces 40.

According to the present invention, it has been discovered that, by securing the second building panels 200 to the pre-existing building layer 80 with at least the adhesive 300 and at least one of the first mechanical fastener 410 at the first depth $D_1$, not only are fewer of the first mechanical fasteners 410 required to seismically secure such plurality of second building panels 200—thereby necessitating fewer first mechanical fasteners 410 to conceal on the facing surface 91, but the concealment process is also simplified as the hole formed into the second building panel 200 by the first mechanical fastener 410 is more easily filled by the concealment compound 500. Thus, the present invention provides a new and improvement seismically stable building surface that can be installed with better aesthetics and requiring less skilled labor during the concealment process.

Subsequent to application of the concealment compound 500, one or more coats of a paint composition 600 may be applied to the entirety of the facing surface 91 of the facing layer 90 comprising the concealment compound 500. Once the facing layer 90 is formed after installing the plurality of second building panels 200, a concealing composition 500 may be applied to a facing surface 91 of the facing layer 90. Non-limiting examples of concealment compound 500 include spackle.

Referring now to FIGS. 3B, 4B, 5B, 6, 7, 8C, 8D a building system 1 may comprise a plurality of the second building panels 200 secured to the support member 50. Each of the plurality of second building panels 200 may be secured directly to the support member 50. Specifically, each of the plurality of second building panels 200 may be secured to the support face 51 of the support member 50. Each of the plurality of second building panels 200 may be directly secured to the support face 51 of the support member 50.

Each of the plurality of second building panels 200 may be secured to the support member 50 by a mechanical fastener 400. In other embodiments, each of the plurality of second building panels 200 may be secured to the support member 50 by the adhesive 300.

During installation, each of the plurality of second building panels 200 may be positioned such that the second major surface 202 of the second building panel 200 faces the support surface 51 of the support member 50. In the embodiment shown in FIGS. 3B and 4B, the second major surface 202 of the second building panel 200 faces upward toward the plenary space 3. According to embodiments where the building system is a wall system, the second major surface 202 may be horizontally oriented and face away from the active room environment 2 (not pictured).

During installation, each of the plurality of second building panels 200 may be positioned such that the first major surface 201 of the second building panel 200 faces away from the support surface 51 of the support member 50. In the embodiment shown in FIGS. 3B and 4B, the first major surface 201 of the second building panel 200 faces downward toward the active room environment 2. According to embodiments where the building system is a wall system, the first major surface 201 may be horizontally oriented and face toward from the active room environment 2 (not pictured).

A first interface 60 may exist between the overlapping space that exists between the second major surface 202 of the second building panel 200 and the support surface 51 of the support member 50. The first interface 60 may comprise adhesive 300. One or more of the mechanical fastener 400 may extend through the first interface 60.

Each of the plurality of second building panels 200 may be secured to the support member 50 by mechanical fastener 400. Each of the plurality of second building panels 200 may be secured to the support member 50 by adhesive 300. Each of the plurality of second building panels 200 may be secured to the support member 50 by the plurality of mechanical fastener 400 and the adhesive 300. The plurality of second building panels 200 installed adjacent to each other may form a facing layer 90.

The mechanical fasteners 400 may comprise the plurality of first mechanical fasteners 410. The plurality of second building panels 200 may be secured to the support member 50 by the plurality of first mechanical fasteners 410.

In securing the second building panel 200 to the support member 50, at least one of the plurality of first fasteners 410 may be driven into the second building panel 200 such that the head 411 of the first fastener 410 is located inset of the first major surface 201 of the second building panel 200. State otherwise, in securing the second building panel 200 to one or more of the first building panel 100, at least one of the plurality of first fasteners 410 may be driven into the second building panel 200 such that the head 411 of the first fastener 410 is located inset of the first major surface 201 of the second building panel 200.

At least one of the plurality of first fasteners 410 may be driven into the second building panel 200 such that the head 411 is entirely positioned between the first major surface 201 and the second major surface 202 of the second building panel 200. At least one of the plurality of first fasteners 410 may be driven into the second building panel 200 such that the head 411 of the first fastener 410 does not overlap with the second major surface 201 of the second building panel 200. At least one of the plurality of first fasteners 410 may be driven into the second building panel 200 such that the proximal end of the head 411 is inset from the first major surface 201 of the second building panel 200 by the first depth $D_1$. The first depth $D_1$ may range from about 1% to about 30% the second thickness $t_2$ of the second building panel 200—including all percentages and sub-ranges therebetween.

In securing the second building panel 200 to the support member 50, at least one of the plurality of first fasteners 410 may be driven into the second building panel 200 such that at least a portion of the threaded body 412 of the first fastener 410 is located inset of the first major surface 201 of the second building panel 200. In securing the second building panel 200 to the support member 50, at least one of the plurality of first fasteners 410 may be driven into the second building panel 200 such that at least a portion of the threaded body 412 of the first fastener 410 is located inset of the first major surface 201 of the second building panel 200 and extends past the first interface 60 and into the support member 50.

In securing the second building panel 200 to the support member 50, at least one of the plurality of first fasteners 410 may be driven into the second building panel 200 such that at least a first portion of the threaded body 412 of the first fastener 410 is located between the first major surface 201 and the second major surface 202 of the second building panel 200, and a second portion of the threaded body 412 extends through the first interface 60, and a third portion of the threaded body 412 extends past the support surface 51 and into the support member 50.

In securing the second building panel 200 to the support member 50, at least one of the plurality of first fasteners 410 may be driven into the second building panel 200 such that at least a first portion of the threaded body 412 of the first fastener 410 is located between the first major surface 201 and the second major surface 202 of the second building panel 200, and a second portion of the threaded body 412 extends through the first interface 60, and a third portion of the threaded body 412 extends past the support surface 51 and into the support member 50—whereby the second portion of the threaded body 412 contacts the adhesive 300 present in the first interface 60.

During installation, the second major surface 202 of at least one of the second building panel 200 is brought into contact with a support surface 51 of the support member 50 to form the first interface 60, whereby the adhesive 300 is present as the first interface 60, and the adhesive is in a state where the adhesive 300 has not yet reach full bond strength.

Installation may further comprise driving at least one of the first mechanical fasteners 410 into the at least one second building panel 200 and the support member 50. The first mechanical fastener 410 may be driven into the second building panel 200 and through the first interface 60 before the adhesive 300 has reached full bond strength. Subsequently, installation may include a time period sufficient for such adhesive 300 to reach full bond strength. After the time period where the adhesive 300 reaches full bond strength, one or more of the plurality of first mechanical fasteners 410 may be removed.

Figure 8C:
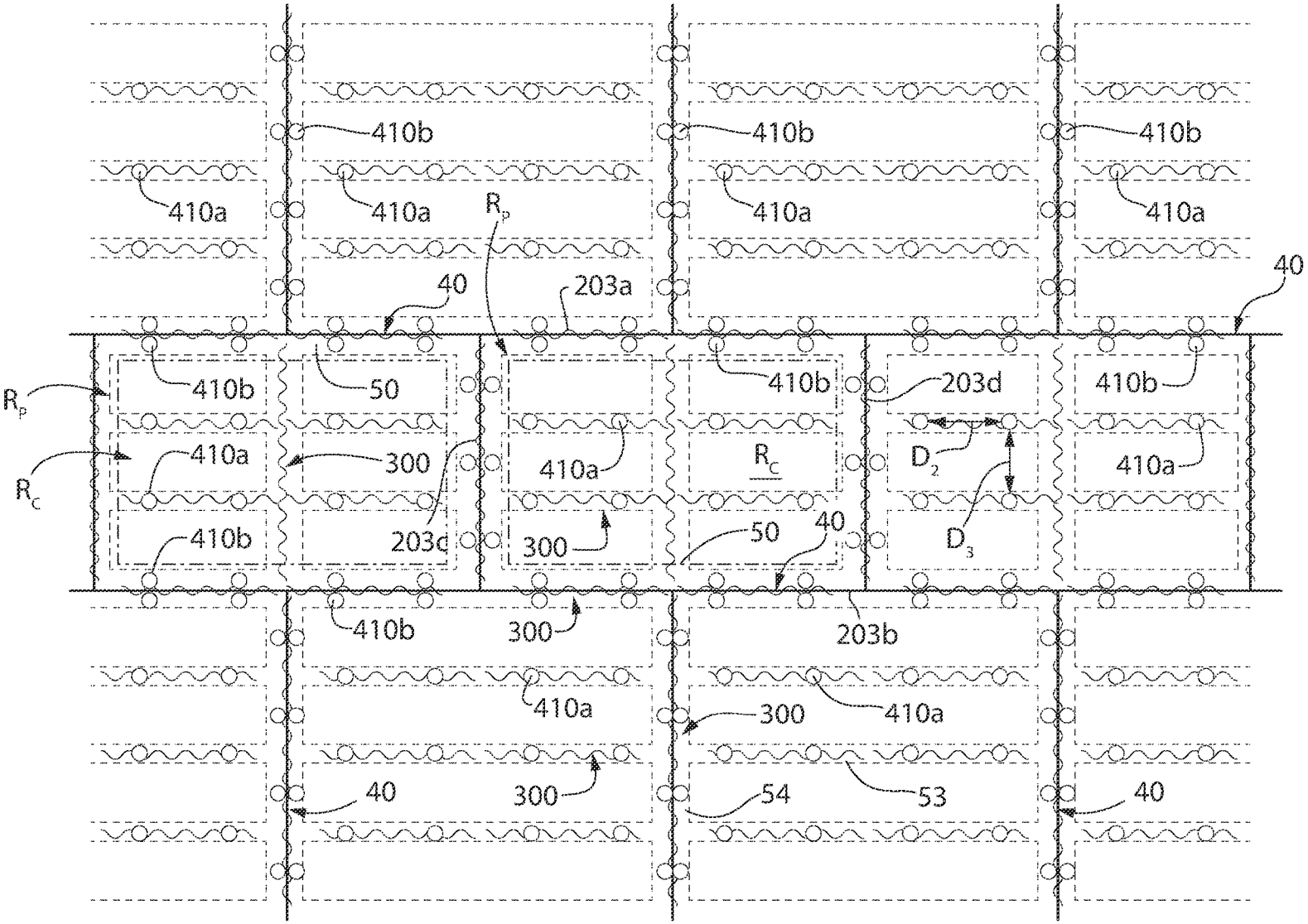
FIG. 8C is an upward view of the second building panel with first building panel of the building system of FIG. 3B being installed according to another embodiment.
Figure 8D:
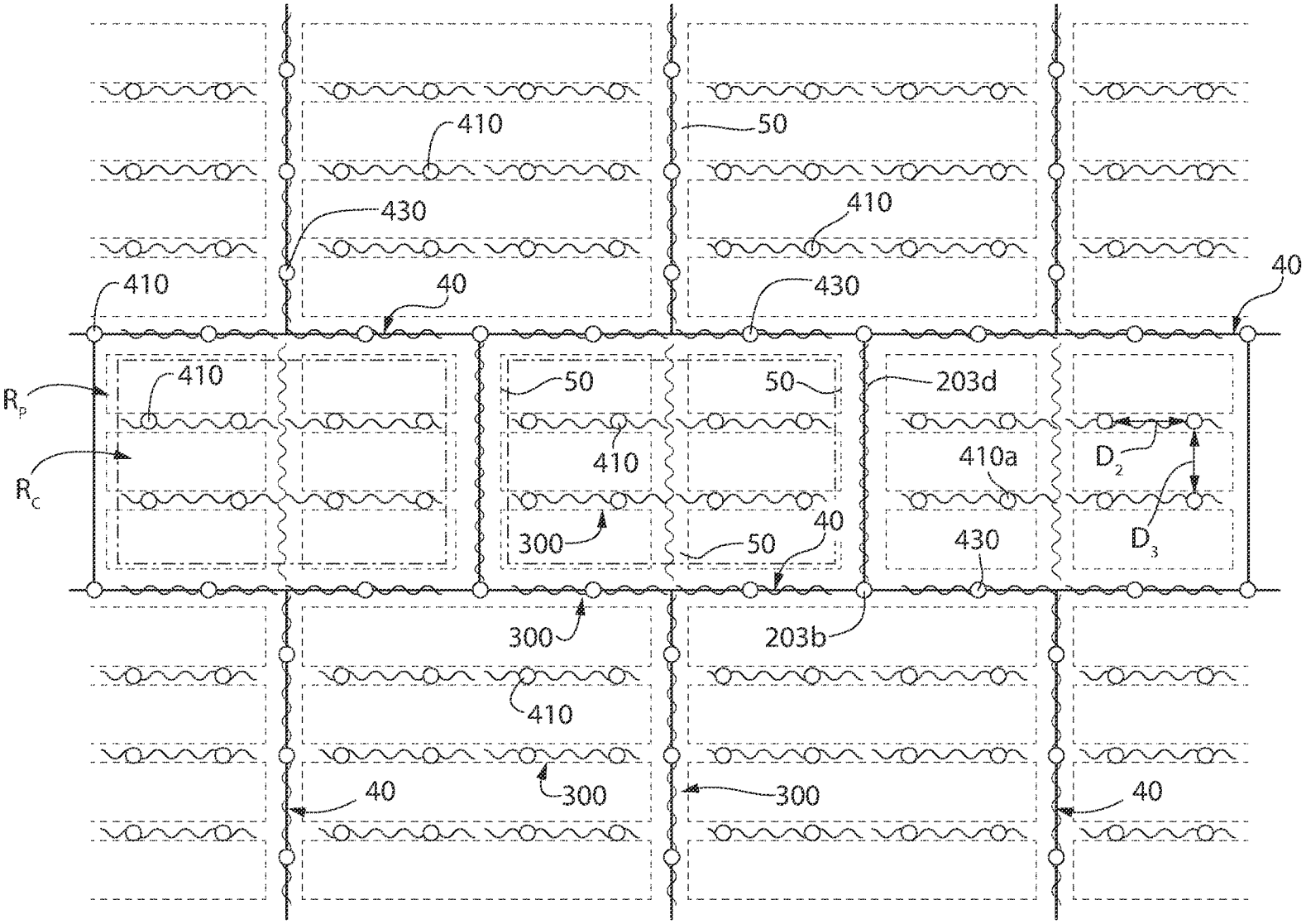
FIG. 8D is an upward view of the second building panel with first building panel of the building system of FIG. 3B being installed according to one embodiment.

Referring now to FIGS. 8C and 8D, the thin dotted linear lines represent the plurality of support members 50 and the thin solid linear lines represent the second building panels 200, and the thin solid wavy lines represent the adhesive 300, and the dotted-dashed linear lines represent the boundary between the central region $R_C$ and the perimeter region $R_P$ of each second building panel 200. The support members 50 are represented by as thin dotted lines so that it may be shown how the plurality of second building panels 200 are oriented relative to the plurality of support members 50 in forming the facing layer 90 as well as the orientation of the adhesive 300 within the first interface 60 located between the support members 50 and the second building panels 200.

When installed, the first side surface 203*a* of a first one of the plurality of second building panels 200 and the second side surface 203*b* of a second one of the plurality of second building panels 200 may both overlap one support member 50. Adhesive 300 may be present in the first interface 60 formed where the first side surface 203*a* of a first one of the plurality of second building panels 200 and the second side surface 203*b* of a second one of the plurality of second building panels 200 overlap one support member 50. A first one of the plurality of first mechanical fasteners 410 may pass through the first one of the plurality of second building panels 200 where that first one of the plurality of second building panels 200 overlaps with the first interface 60 and a second one of the plurality of first mechanical fasteners 410 may pass through the second one of the plurality of second building panels 200 where that second one of the plurality of second building panels 200 overlaps with the first interface 60.

When installed, the third side surface 203*c* of a first one of the plurality of second building panels 200 and the fourth side surface 203*d* of a second one of the plurality of second building panels 200 may both overlap one support member 50. Adhesive 300 may be present in the first interface 60 formed where the third side surface 203*c* of a first one of the plurality of second building panels 200 and the fourth side surface 203*d* of a second one of the plurality of second building panels 200 overlap one support member 50. A first one of the plurality of first mechanical fasteners 410 may pass through the first one of the plurality of second building panels 200 where that first one of the plurality of second building panels 200 overlaps with the first interface 60 and a second one of the plurality of first mechanical fasteners 410 may pass through the second one of the plurality of second building panels 200 where that second one of the plurality of second building panels 200 overlaps with the first interface 60.

When installed, at least one of the plurality of second building panels 200 may be positioned such that the first elongated edge 203*a* (first side surface 203*a*) and/or the second elongated edge 203*b* (second side surface 203*b*) overlaps with an elongated one 53 of the support member 50. When installed, at least one of the plurality of second building panels 200 may be positioned such that the third side surface 203*c* (first transverse edge) and/or the second side surface 203*d* (second transverse edge) overlaps with a transverse one 54 of the support member 50. If during installation a transverse one 54 of the support member 50 does not previously exist, such transverse one 54 of the support member 50 may be installed such that the second building panel 200 can overlap along the third and/or fourth side surface 203*c*, 203*d*.

As demonstrated by FIGS. 8C and 8D, the adhesive 300 may be applied in a plurality of lateral strips. Although not shown, the adhesive 300 may be applied in a plurality of longitudinal strips. The orientation of the strips may be applied such that the adhesive 300 is present in the first interface 60—regardless of orientation of the second building panel 200 relative to the support members 50.

As demonstrated by FIG. 8C, the plurality of second building panels 200 may be secured to the support members 50 by a first plurality of first mechanical fasteners 410*a* and second plurality of first mechanical fasteners 410*a*—whereby the first plurality of first mechanical fasteners 410*a* are located within the central region $R_C$ and the second plurality of second mechanical fasteners 410*b* are located within the perimeter region $R_P$.

According to such embodiments, the perimeter region $R_P$ may have a perimeter distance ranging from about 0.5 inches to about 1.0 inches—including all distances and subranges there-between. According to such embodiments, the first plurality of first mechanical fasteners 410*a* may be present in the central region $R_C$ an amount ranging from about 4 to about 12—including all integers and sub-ranges there-between. In some embodiments, the first plurality of first mechanical fasteners 410*a* may be present in the central region $R_C$ an amount ranging from about 4 to about 8—including all integers and sub-ranges there-between. According to such embodiments, the first plurality of first mechanical fasteners 410*a* may have a longitudinal separation distance $D_2$ ranging from about 15 inches to about 21 inches—including all distances and subranges there-between. In some embodiments, the first plurality of first mechanical fasteners 410*a* may have a longitudinal separation distance $D_2$ of about 16 inches to about 18 inches.

The first plurality of first mechanical fasteners 410*a* may have a longitudinal separation distance $D_2$ that is equal to about 15% to about 30% the second length $L_2$ of the second building panel 200—including all percentages and sub-ranges there-between.

According to such embodiments, the second plurality of first mechanical fasteners 410*b* may be present in the perimeter region $R_P$ an amount such that the second plurality of first mechanical fasteners 410*b* are separated by longitudinal separation distance $D_2$ and a lateral separation distance $D_3$ ranging from about 6 inches to about 15 inches—including all distances and sub-ranges there-between. The second plurality of first mechanical fasteners 410*b* may have a longitudinal separation distance $D_2$ that is equal to about 6% to about 15% the second length $L_2$ of the second building panel 200—including all percentages and sub-ranges there-between.

According to such embodiments, where adhesive 300 is present in the second interface 70, the first plurality of first mechanical fasteners 410*a* and the second plurality of first mechanical fasteners 410*b* should extend through the adhesive 300.

The first plurality of first mechanical fastener 410*a* may be present in a first fastener density. The first fastener density may be calculated as the total number of the first plurality of first mechanical fasteners 410*a* that are located within the first surface area of the first major surface 201 of the second building panel 200. The second plurality of first mechanical fastener 410*b* may be present in a second fastener density. The second fastener density may be calculated as the total number of the second plurality of first mechanical fasteners 410*b* that are located within the first surface area of the first major surface 201 of the second building panel 200.

The first fastener density and the second fastener density may not be equal. The second fastener density may be greater than the first fastener density. The first fastener density may range from about 0.15 fasteners/$ft^2$ to about 0.5 fasteners/$ft^2$—including all densities and sub-ranges there-between. The second fastener density may range from about 0.6 fasteners/$ft^2$ to about 1.3 fasteners/$ft^2$—including all densities and sub-ranges there-between. A ratio of the second fastener density to the first fastener density may range from about 1.2:1 to about 8.6:1—including all ratios and sub-ranges there-between.

Referring now to FIG. 8D, an alternative to the embodiment of FIG. 8C is shown, whereby the plurality of second building panels 200 and may be secured by a plurality of the first mechanical fasteners 410 and a plurality of the third mechanical fasteners 430. According to this embodiment, the second building panel 200 may be secured such that the plurality of the first mechanical fasteners 410 are located within the central region $R_C$ of the second building panel 200 and a plurality of the third mechanical fasteners 430 along the edge interface 40 of adjacent second building panels 200.

According to such embodiments, the perimeter region $R_P$ may be free of the first mechanical fastener 410 whereby only the central region $R_C$ comprises the first mechanical fastener 410. In other embodiments, the perimeter region $R_P$ may comprise one or more of the first mechanical fastener 410.

For the third mechanical fasteners 430 located along the edge interface 40, the lateral separation distance $D_3$ may range from about 8 inches to about 30 inches—including all distances and sub-ranges there-between.

As demonstrated by FIG. 8D, the plurality of second building panels 200 may be secured to the support members 50 by a plurality of first mechanical fasteners 410 and plurality of third mechanical fasteners 430. In such embodiments, the edge interface 40 may comprise the plurality of third mechanical fasteners 430.

Subsequent to application of the concealment compound 500, one or more coats of a paint composition 600 may be applied to the entirety of the facing surface 91 of the facing layer 90 comprising the concealment compound 500.

Referring now to FIGS. 9-11, subsequent to application of the concealment compound 500, one or more coats of a paint composition 600 may be applied to the entirety of the facing surface 91 of the facing layer 90 comprising the concealment compound 500. Once the facing layer 90 is formed after installing the plurality of second building panels 200, a concealing composition 500 may be applied to a facing surface 91 of the facing layer 90. Non-limiting examples of concealment compound 500 include spackle.

According to the present invention, it has been discovered that, by securing the second building panels 200 to the support member 50 with at least the adhesive 300 and at least one of the first mechanical fastener 410 at the first depth $D_1$, not only are fewer of the first mechanical fasteners 410 required to seismically secure such plurality of second building panels 200—thereby necessitating fewer first mechanical fasteners 410 to conceal on the facing surface 91, but the concealment process is also simplified as the hole formed into the second building panel 200 by the first mechanical fastener 410 is more easily filled by the concealment compound 500. Thus, the present invention provides a new and improvement seismically stable building surface that can be installed with better aesthetics and requiring less skilled labor during the concealment process.

Subsequent to application of the concealment compound 500, one or more coats of a paint composition 600 may be applied to the entirety of the facing surface 91 of the facing layer 90 comprising the concealment compound 500. Once the facing layer 90 is formed after installing the plurality of second building panels 200, a concealing composition 500 may be applied to a facing surface 91 of the facing layer 90. Non-limiting examples of concealment compound 500 include spackle.

What is claimed is:

1. A building system comprising:

a plurality of support members located in a plenary space of an interior building space, each support member comprising a support surface;

a plurality of first building panels located below the plenary space and secured directly to the support surface of the plurality of support members, each of the plurality of first building panels comprising a non-porous body, each of the first building panels comprising a first major surface opposite a second major surface and a side surface extending between the first major surface and the second major surface; and a plurality of second building panels secured directly to the plurality of first building panels by an adhesive and a plurality of first mechanical fasteners, each of the plurality of the second building panels comprising a porous body, each of the second building panels comprising a first major surface opposite a second major surface and a side surface extending between the first major surface and the second major surface;

wherein the second major surface of the plurality of first building panels faces the support surface of the plurality of support members; and wherein the second major surface of the plurality of the second building panels faces the first major surface of the plurality of first building panels.

2. The building system according to claim 1, wherein the plurality of first mechanical fasteners each comprise a head and a threaded body, and wherein the threaded body of one of the plurality of first mechanical fasteners extends through at least a portion of the porous body of one of the plurality of second building panels and at least a portion the non-porous body of one of the plurality of first building panels, wherein the head of at least one of the plurality of first mechanical fasteners is located between the first major surface and the second major surface of the plurality of second building panels.

3. The building system according claim 1, wherein a first interface exists between the second major surface of the plurality of first building panels and the support surface of the plurality of support members and a second interface exists between the second major surface of the plurality of second building panels and the first major surface of the plurality of first building panels, wherein the adhesive is present in the second interface, and wherein the first interface is substantially free of the adhesive.

4. The building system according to claim 3, wherein the threaded body of the plurality of first mechanical fasteners extends through the second interface, and wherein the threaded body of at least one of the plurality of first mechanical fasteners does not extend through the first interface.

5. The building system according to claim 1, wherein the non-porous body comprises dry-wall, gypsum board, plywood, particle board, and combinations thereof, wherein the porous body is formed of a fibrous material, wherein the fibrous material is an inorganic fiber, and wherein the inorganic fiber is selected from the group consisting of mineral wool, rock wool, stone wool, and glass fibers.

6. The building system according to claim 1, wherein the non-porous body has a first body density and the porous body has a second body density, wherein the first body density and the second body density are not equal, wherein the first body density ranges from about 16 lb./ft$^3$ to about 180 lb./ft$^3$, wherein the second body density ranges from about 2 lb./ft$^3$ to about 16 lb./ft$^3$, and wherein a ratio of the first body density to second body density ranges from about 1.5:1 to about 10:1.

7. The building system according to claim 1, further comprising a plurality of second mechanical fasteners that each comprise a head and a threaded body, and wherein the threaded body of the plurality of second mechanical fasteners extends through at least a portion of the non-porous body of one of the plurality of first building panels and the support surface of one of the plurality of support members, wherein the side surface of the first building panel defines a perimeter of the first building panel, and wherein the plurality of first mechanical fasteners are present within the perimeter of one of the second building panels in first fastener density and the plurality of second mechanical fasteners are present within the perimeter of one of the first building panels in a second fastener density, wherein the first fastener density and the second fastener density are not equal.

8. The building system according to claim 7, wherein the second fastener density is greater than the first fastener density, wherein the first fastener density ranges from about 0.2 fasteners/ft$^2$ to about 0.75 fasteners/ft$^2$, wherein a ratio of the second fastener density to first fastener density ranges from about 1.1:1 to about 10:1.

9. The building system according to claim 1, wherein each of the plurality of first building panels has a first thickness as measured between the first major surface and the second major surface of the first building panels, and each of the plurality of second building panels has a second thickness as measured between the first major surface and the second major surface of the second building panels, and wherein the first thickness and the second thickness are not equal.

10. The building system according to claim 9, wherein the first thickness ranges from about 0.3 inches to about 0.75 inches, wherein the second thickness ranges from about 0.4 inches to about 1.6 niches, wherein a ratio of the second thickness to the first thickness ranges from about 3.0:1 to about 1.25:1, wherein each of the plurality of first mechanical fasteners has a first fastener length, and wherein a ratio of first fastener length to second thickness ranges from about 1.25:1 to about 2.5:1.

* * * * *